United States Patent [19]

Rush et al.

[11] 4,327,415

[45] Apr. 27, 1982

[54] TRANSIT VEHICLE HANDBACK CONTROL APPARATUS AND METHOD

[75] Inventors: Donald L. Rush, Penn Hills; Robert H. Perry, Peters Township, Allegheny County; Richard S. Rhoton, Mt. Lebanon, all of Pa.

[73] Assignee: Westinghouse Electric Corp., Pittsburgh, Pa.

[21] Appl. No.: 117,417

[22] Filed: Jan. 31, 1980

[51] Int. Cl.[3] ..... B61L 27/00

[52] U.S. Cl. ..... 364/436; 364/424; 246/5; 246/187 C

[58] Field of Search ..... 364/424, 426, 436; 371/8, 68; 246/5, 187 R, 187 A, 187 B, 187 C; 318/563, 564

[56] References Cited

U.S. PATENT DOCUMENTS

| | | | |
|---|---|---|---|
| 4,041,470 | 8/1977 | Slane et al. | 364/426 |
| 4,208,717 | 6/1980 | Rush | 364/426 |
| 4,209,828 | 6/1980 | Anderson et al. | 364/426 |
| 4,217,643 | 8/1980 | Anderson et al. | 246/187 R |
| 4,247,897 | 1/1981 | McDonald et al. | 246/5 |

FOREIGN PATENT DOCUMENTS

| | | | |
|---|---|---|---|
| 2025104 | 1/1980 | United Kingdom | 246/5 |

OTHER PUBLICATIONS

Bollinger, The BARTD Train Control System, Railway Signalling and Communication, Dec. 1967, pp. 18–23.

Thorne-Booth, Signalling of Remotely Controlled Railway Trains, IEEE Transactions on Communication Technology, vol. Com-16, No. 3, Jun. 1968, pp. 369–374.

Gibson, Bay Area Transit System Will Have Automated Central Control-Westinghouse Engineer, Mar. 1970, pp. 51–54.

Hoyler, Design Techniques for Automatic Train Control, Westinghouse Engineer, Jul. 1972, pp. 98–103.

Hoyler, Automatic Train Control Concepts are Implemented by Modern Equipment, Westinghouse Engineer, Sep. 1972, 145–151.

"Sao Paulo Metro E-W Line Innovations" Published in the Conference Record of the IEEE Industry Applications Society Meeting in Oct. 1977, pp. 1105–1109.

"Atlanta Airport People Mover" Published in the Conference Record of the 28th IEEE Vehicular Technology Group Meeting in Mar. 1978, pp. 1–20.

"The Sao Paulo Metro Automated Transit System" Published in the Rapid Transit Conference of the American Public Transit Association Meeting in Jun., 1978.

*Primary Examiner*—Mark E. Nusbaum
*Assistant Examiner*—Gary Chin
*Attorney, Agent, or Firm*—R. G. Brodahl

[57] ABSTRACT

There is disclosed a vehicle train control apparatus and method for controlling the operation of a vehicle train by a second control equipment provided in a different control vehicle of the train in the event of the failure of the train control equipment of a first control vehicle initially selected to control the train.

16 Claims, 23 Drawing Figures

TRANSIT VEHICLE HANDBACK CONTROL APPARATUS AND METHOD

CROSS-REFERENCE TO RELATED APPLICATION

The present application is related to a patent application Ser. No. 920,043, now abandoned, that was filed June 28, 1978 by Thomas D. Clark et al and entitled "Train Vehicle Controlled Multiplex Train Line" and is related to a patent application Ser. No. 920,318 now issued as U.S. Pat. No. 4,208,717 that was filed June 28, 1978 by Donald L. Rush and entitled "Program Stop Control of Train Vehicles", which patent applications are assigned to the same assignee as the present application; the disclosures of these related patent applications are incorporated herein by reference.

BACKGROUND OF THE INVENTION

It was known in the prior art of transit vehicle control systems to provide redundant control apparatus in relation to the one or more important component portions of the vehicle control system, such that a failure of some component portion would not prevent the operational movement of a vehicle along the roadway track. With such a redundant arrangement a spare component apparatus is provided to stand by each of those more important portions of the control system.

The present cost of transit systems requires the minimum number of roadway tracks to be installed because of the high expense of building those tracks underground or elevated, and therefore in effect a one lane vehicle roadway track is provided in each direction along which each transit vehicle passes. If any vehicle stops or fails to move it will block the whole roadway track. Since the real purpose of a transit vehicle system is to move passengers, the individual vehicles are desired to keep moving at all times.

A vehicle automatic train control or ATC apparatus is provided to control the operation of each train of vehicles, which train may consist of a plurality of coupled pairs of vehicle cars. Each pair of cars or each provided control car includes a complete ATC apparatus. The ATC apparatus interfaces with the wayside train control equipment to receive and/or transmit data used for the safe control of the train, such as speed command signals, station program stop information, identification, performance modification and door control signals. The vehicle ATC also receives inputs from car subsystems and from the operator's console in relation to desired operating modes and car status. The operational modes are ATO, MCS and Manual; in automatic train operation mode the propulsion request is provided by the propulsion and brake train lines with overspeed protection to keep actual speed from exceeding the commanded speed; in manual cab signal mode the operator responds to received speed commands on his console by controlling the propulsion and braking activity of the train; in manual mode the train control system on the vehicle is bypassed, but the operator is limited to a predetermined speed such as 20 KPH and responds to orders from the central control operator.

One of the failures that can stop a transit vehicle system is the breakdown or failure of the automatic train control system on any one train of vehicles. The several backup modes of operation, atomatic, manual with cab signalling and manual have their common points, for example, automatic and MCS require that the automatic train protection portion of the automatic train control or ATC equipment satisfactorily operates, and if that particular part of the equipment fails, then a manual mode of operation is required. The manual mode is generally limited to something in the order of 20 KPH because of the system safety reqirements, and in addition it is desired to move passengers at fast speeds and at close headways which an operator has difficulty doing.

In an article entitled The Bartd Train Control System that was published in Railway Signalling and Communications for December 1967 at pages 18–23 the train control system for the San Francisco Bay Area Rapid Transit District was described. Other articles relating to the same train control system were published in the IEEE Transactions on Communication Technology for June 1968 at pages 369–374, in Railway Signalling and Communications for July 1969 at pages 27–38, in the Westinghouse Engineer for March 1970 at pages 51–54, in the Westinghouse Engineer for July 1972 at pages 98–103, and in the Westinghouse Engineer for September 1972 at pages 145–151. A general description of the train control system now being provided for the Sao Paulo, Brazil Metro is set forth in an article published in the Conference Record of the October 1977 Meeting of the IEEE Industry Application Society at pages 1105–1109. A description of the train control system now being provided for the Atlanta Airport People Mover is set forth in an article published for the 28th Conference of the IEEE Vehicular Technology Group at Denver, Colo. in March 1978, and in an article entitled The Sao Paulo Metro Automated Transit System that was published for the Rapid Transit Conference of the American Public Transit Association in Chicago, Ill. in June 1978.

A general description of microprocessors suitable for use in the present invention and related peripheral devices is provided in the Intel 8080 Microcomputer Systems Users Manual currently available from Intel Corporation, Santa Clara, Calif. 95051.

SUMMARY OF THE INVENTION

For a modern mass transit system, a train of vehicles is typically controlled by an automatic train control or ATC in each of selected control cars which can be in the pairs of A and B cars. An important consideration is the availability of the train of vehicles to move passengers, such that reliability and availability of the train must be high, and since the train control systems have become automated, this includes the availability of that automatic train control. If a train should fail to operate due to the failure of the front ATC, it is necessary to be able to move the train preferably under automatic mode in order to either get it off the roadway track or to keep the train in service such that the roadway track does not jam up with other trains behind the failed train.

In accordance with the present invention if the front control car ATC should fail, certain essential functions which would allow the train to move under the varying degrees of automation can be handed back to the similar ATC equipment in the rear car pair of the train which would still be operating. The provided handback interface switching networks recognize which car is the front car and which car is the rear car, and uses the ATC equipment of the rear control car of the train for controlling the movement of the train when the front ATC equipment has failed and handback operation is requested by the train operator. This involves sending many critical signals from the front end of the train to the rear end of the train, and the equipment that sends these critical signals must be made either totally redundant or extremely reliable so that it does not adversely affect the reliability of the overall train control operation. When handback is operational, one mode of handback operation is automatic with the total control of the train handed back and done by the rear ATC equipment, with some selected inputs from the operator and his console in the front car and from antennas located in front of the train, and another mode of handback operation is MCS or manual with cab signalling that uses speed regulation for overspeed protection provided by the rear ATC which acts as a limiting function so the operator-provided manual speed command functions at the front car are limited by the ATC operation of the rear car.

DESCRIPTION OF THE PREFERRED EMBODIMENT

Figure 1:
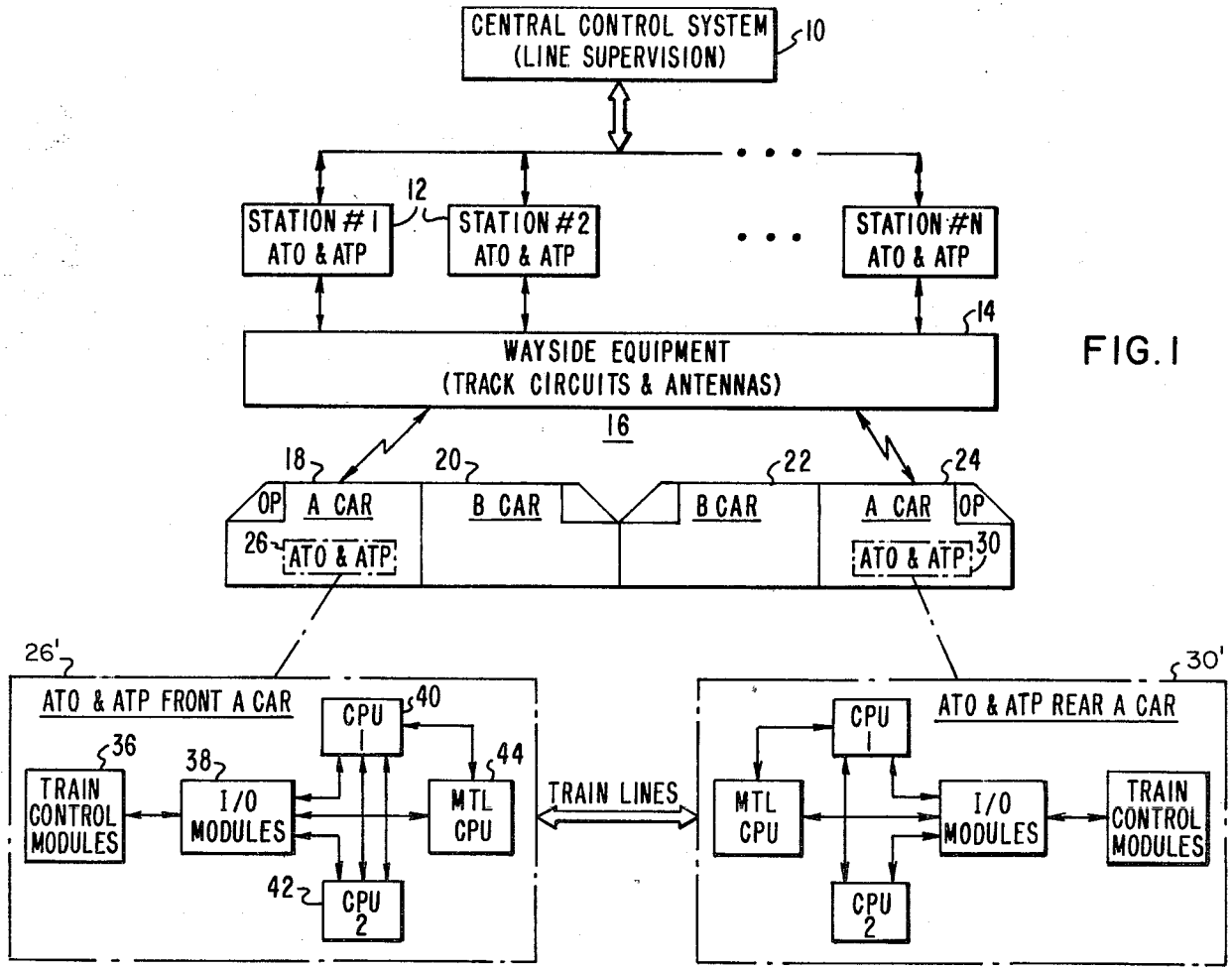
FIG. 1 is a schematic showing of a passenger vehicle control system suitable for operation with the present invention.

In FIG. 1 there is shown a central control system 10, which is usually located in a headquarters building and receives information about the transit system and individual vehicle train operation from a system operator in relation to applied desired performance adjustments to the individual vehicle trains. The central control system 10 supervises the schedule, spacing and routing of the individual trains. The passenger loading and unloading stations 12 are provided to operate with the central control 10 as desired for any particular transit system. The wayside equipment 14 including track circuits and associated antenna for speed command, door control and program stop control signals is located along the vehicle track roadway between the stations and is provided to convey information in relation to passenger vehicles travelling along the roadway track. A first train 16 is shown including four vehicle cars 18, 20, 22 and 24 arranged in two vehicle units or pairs of A and B cars, with an A-type car 18 at the front of the train and an A-type car 24 at the rear of the train with intermediate B-type cars 20 and 22. The automatic train operation ATO and automatic train protection ATP make up the automatic train control ATC apparatus 26 carried by the front A-type car 18 and shown in greater detail in the phantom showing 26' for the front car 18. Similarly, the automatic train operation and automatic train protection apparatus 30 carried by the rear A-type car 24 make up the ATC equipment shown in greater detail in the phantom showing 30' for the rear car 24. The train control modules 36 in the automatic train control ATC apparatus 26' includes the program stop receiver module, the speed code receiver module, the vital interlock board and power supplies and all the modules required to interface with the other equipment carried by the train vehicle 18, and in accordance with the more detailed description set forth in above reference related application Ser. No. 920,318 now U.S. Pat. No. 4,208,717. Information is sent in relation to the input/output modules 38, and the microprocessor computers 40, 42 and 44. There is a direct communication link through the input/output modules 38 between the CPU1 computer 40 and the CPU2 computer 42. There is a direct communication link from the CPU1 computer 40 to the multiplex train line CPU computer 44. A similar train control apparatus is provided for the rear car 24.

The front car 18 and the rear car 24 are connected through train lines which include the couplers of the individual train vehicles. The multiplex train line apparatus, disclosed in the above-referenced related patent application Ser. No. 920,043, now abandoned is used to send many pieces of operational information from one end of the train to the other end of the train through coupling wires. The apparatus can be controlled by the Intel 8080 CPU 44 in cooperation with the Intel 8080 CPU's 40 and 42 and ties the hardware components together by an 8-bit data bus and is in turn controlled by a software program which has been stored in its memory as described in more detail in this related patent application.

Figure 2:
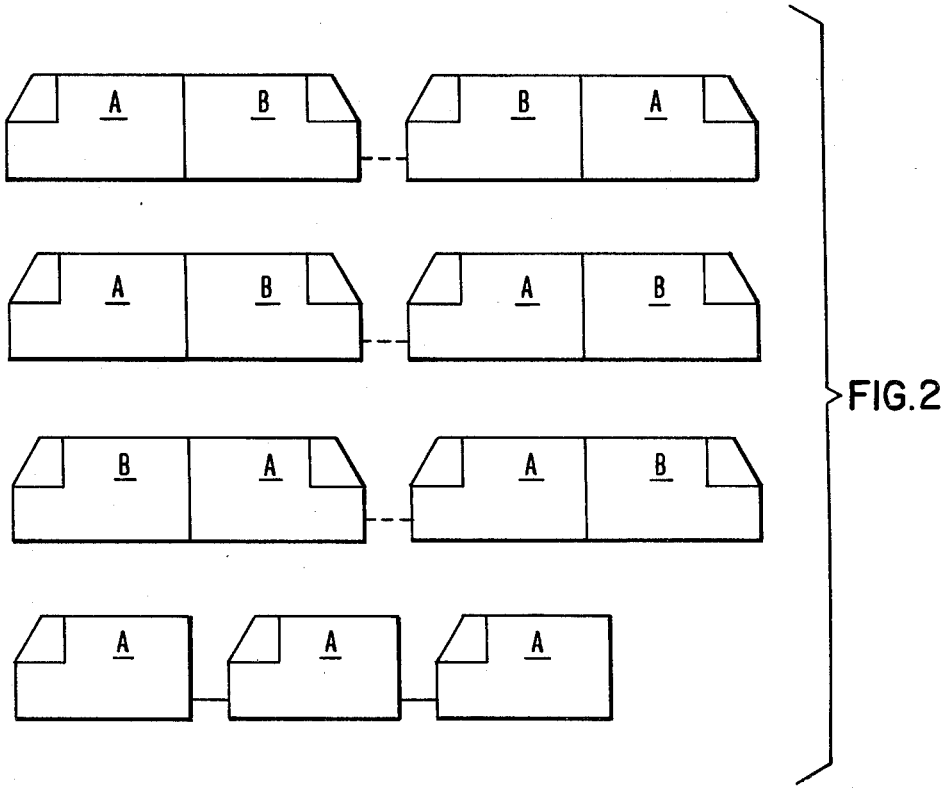
FIG. 2 shows several well-known operational arrangements of vehicle pairs or vehicle units for transit systems.

In FIG. 2 there is shown various configurations of an A car coupled with a B car as a vehicle unit pair such as used by the Sao Paulo Metro in Brazil, with each A and B pair having one ATC apparatus usually located in the A car and with each train usually including three such sets of married pairs. The Bart System in San Francisco uses a front A car and a rear A car with several filler B cars, and an ATC unit in each of the front A car and the rear A car. The front ATC apparatus normally is in control of the train when the train is going in one direction and the rear ATC apparatus would be in control when the train is going in the opposite reverse direction. A fourth type of transit system would be such as is operative at the Seattle-Tacoma Airport where each train is made up of several A control cars, with each such A car having an ATC apparatus and with the lead or front car controlling the entire train.

Figure 3:
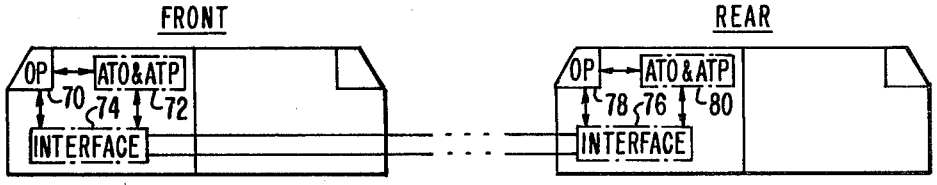
FIG. 3 diagrammatically shows the vehicle unit carried arrangement of the automatic train control (ATC) and the handback equipment of the present invention.

In FIG. 3 there is shown an AB pair of cars in the front of the train and a similar AB pair of cars in the rear of the train. The A car includes the operator's console 70 operative with the automatic train control or ATC apparatus 72 including automatic train operation and automatic train protection units coupled through a handback interface 74 to a similar interface 76 in the rear of the train and operative with an operator's console 78 and a similar ATC apparatus 80.

Figure 4:
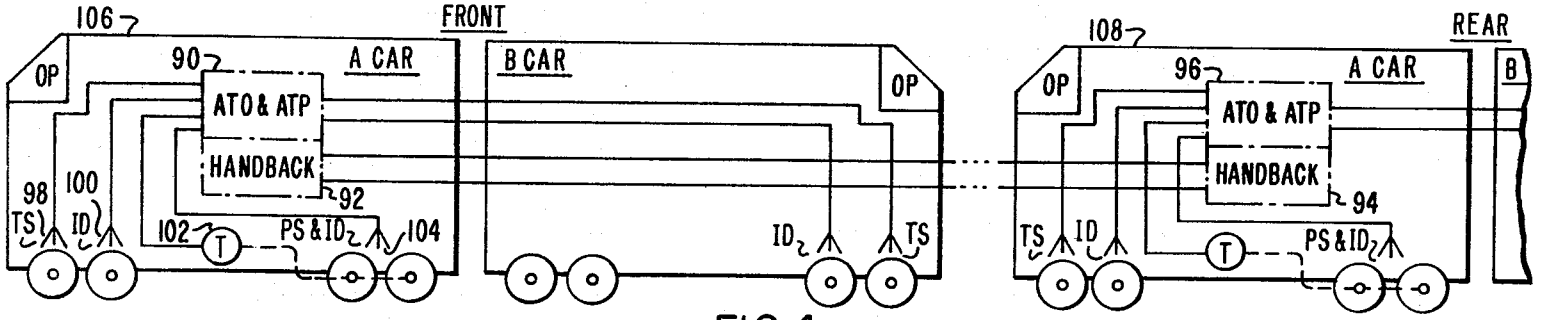
FIG. 4 shows the handback equipment of the front vehicle unit connected with the handback equipment of the rear vehicle unit of a train of vehicle cars.

In FIG. 4 there is shown a front A and B pair of cars operative with a rear A and B pair of cars, with the front A or primary control car 106 including the automatic train control ATC equipment 90 coupled with a handback control apparatus 92 which is operative with a similar handback control apparatus 94 in the rear A or secondary control car 108 and that in turn is operative with an ATC equipment 96 in the rear A car. The front A car 106 includes a track signal antenna 98, an ID antenna 100, a tachometer 102 and a program stop and ID antenna 104 for providing desired input signals to the ATC equipment 90. In accordance with the present invention the ATC equipment 96 shown in the rear control car of the train, which previously has only been used for running the train in an opposite direction, such as to the right as shown in FIG. 4, can now be employed under handback to command the train when the train is running in a direction to the left as shown in FIG. 4. When the train is operative in handback it is necessary for the handback interface 92 to be coupled through the handback interface 94 to allow the two equipments to work together in view of the need for certain pieces of equipment in the front A control car 106 to send signals to the rear A control car 108 for this purpose. The rear control car 108 must operate the same as a front control car in response to signals from the antennas, such as the track signal antenna 98 of the front car and the identification antenna 100 and the program stop antenna 104 carried by the front car 106. In addition, because of tachometer operation, the rear car has to be controlled to operate backwards in relation to the train moving in a direction to the left as shown by the arrow in FIG. 4 and functionally as though the automatic train control equipment 96 carried by the rear control car 108 were located in the front control car 106.

Figure 5:
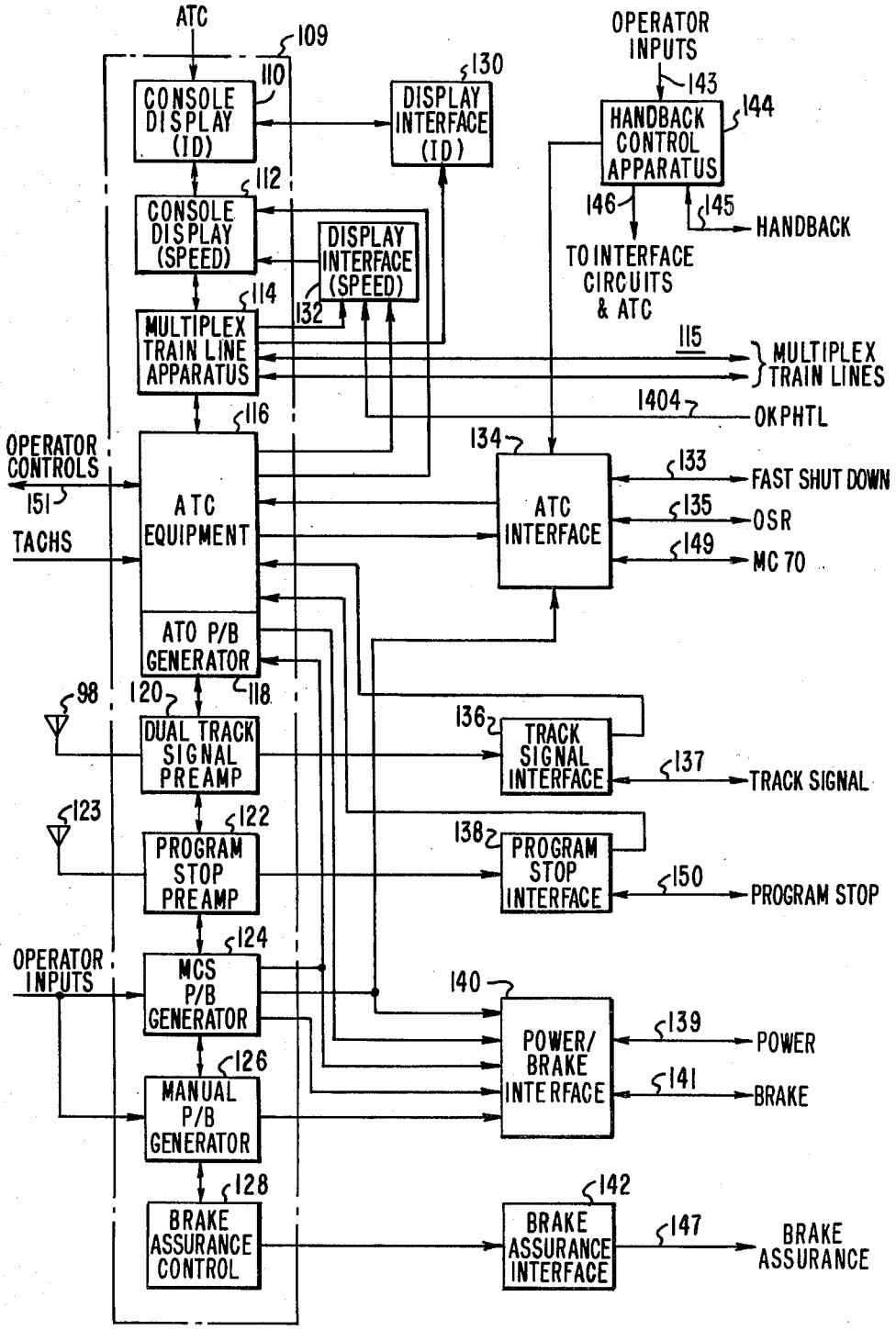
FIG. 5 is a diagram illustrating the operational arrangement of the handback interface equipment provided for each vehicle unit or pair of A and B cars and operative with the automatic train control (ATC) apparatus of that pair of the transit vehicle cars.

In FIG. 5 there is shown a block diagram of the handback interface equipment and associated signal flow relationships of the ATC equipment 109 carried by each of the A control cars. The ATC equipment 109 includes the ID console display 110 and the speed console display 112 for the operator, the multiplex train line apparatus 114, the ATC equipment 116 including the ATO power and brake generator 118, the dual track signal preamplifiers 120, the program stop preamplifier 122, the manual cab signaling P and brake generator 124, the manual P and brake generator 126 and the brake assurance control 128. Operative with the ID console display 110 is an ID display interface 130. Operative with the speed console display 112 is a speed display interface 132. Operative with the automatic train control (ATC) equipment 116, including the automatic train operation (ATO) and the automatic train protection (ATP) equipment, is the ATC interface 134. Operative with the dual track signal preamplifiers 120 is the track signal interface 136. Operative with the program stop preamp 122 is the program stop interface 138. Operative with the manual cab signaling power and brake generator 124 and the manual power and brake generator 126 is the power and brake interface 140. Operative with the brake assurance control 128 is the brake assurance interface 142. Operative with each of the interface circuits 130, 132, 134, 136, 138, 140 and 142 is a handback control apparatus 144.

The handback control apparatus 144 receives an input 143 from an operator controller key switch, or it could be from a programmed digital computer if desired for an automatic operation, indicating a desire for the control apparatus to operate in the handback mode. The various interface circuits 130, 132, 134, 136, 138, 140 and 142 and the handback control apparatus 144 includes logic devices that set up the necessary interface signal circuits to accomplish the desired handback operation of the train control functions. Similar interface circuit apparatus as shown in FIG. 5 is provided for each vehicle unit or pair of cars, including the front control car and the rear control car. There are two outputs from the handback control apparatus 144. One output 145 driving the handback train lines to the rear of the train which tells the A car in the rear of the train that the front A car desires a handback operation and therefore the rear A car will control the train and sets up the interface circuits in the rear A car to be in command of the train. For example, in automatic handback operation, the ATC equipment 116 of the rear control car responds to speed control signals from the roadway track and operates with the rear power and brake generator 118 for controlling the train, while in MCS handback operation the operator input 143 from the controller key switch functions with the ATC equipment 116 of the front control car with overspeed control from the rear control car by the OSR train line 135. The other output 146 operates with each of the interface circuits shown in FIG. 5, as will be later explained.

For each vehicle unit, such as a married or coupled pair of cars A and B, there is provided the apparatus shown in FIG. 5. The interface circuit 130 operative with the ID console display 110 and the interface circuit 132 operative with the speed console display 112 are primarily two direction ports which either take data such as destination, serial number, train length and so forth from the ATC equipment 116 through the multiplex train line apparatus 114 and applies it to the console ID display 110 or the speed console display 112 or in the handback mode the interface circuits 130 and 132 operate through the multiplex train line apparatus 114, which is the communications channel from the front ATC equipment 116 and the operator in the front of the train to the corresponding rear ATC equipment in the rear A car of the train. The multiplex train line apparatus 114 is described in greater detail in above referenced patent application Ser. No. 920,043, now abandoned and it handles all information that is non-vital such as the ID console display information, the speed console display information and program stop and status information, back and forth between the front pair of cars and the rear pair of cars of the train. The ATC equipment 116 handles all the information required for train control functions such as track signalling, program stop, door control, ID display, speed maintaining and overspeed control and is primarily responsible for moving the train.

The rear ATC equipment 116 in the automatic handback mode provides the P signal drive through the rear power and brake generator 118 operative with the interface circuit 140 and the P signal train line 139 to all cars of the train and provides the brake signal drive through the brake signal train line 141 to all cars of the train. A selected one of the rear P and brake signal generators in automatic ATO handback operation has to be interfaced to one of the P signal train line 139 and the brake train line 141 which are vital signals, through the interface circuit 140 during the handback mode of operation. The operator determines which of these P signal generators will be operating. It should be understood that the here disclosed handback control apparatus can operate with the well known cam control system for determining train operation through a multiplicity of power train lines and brake train lines. The rear ATC equipment 116 in handback provides the overspeed relay control through the interface circuit 134 and the OSR control train line 135 and the fast shutdown control through the fast shutdown train line 133. These are vital train line functions and are not handled by the multiplex train line apparatus 114.

The ATC equipment 116, in the front control car for normal operation or in the rear control car for handback, controls the power brake generator 118 which basically provides the P effort request signal for determining the propulsion effort of the train and a brake signal for determining the brake effort of the train. In MCS handback one of the MCS P signal generator 124 and manual P signal generator 126 in the front control car is controlled by operator input signals, with the MCS P signal generator 124 having supervision from the rear car automatic train protection portion of the ATC equipment 116 to establish any overspeed operating conditions and having supervision through the ATC interface circuit 134 for primarily the fast shutdown under handback conditions and the overspeed relay control.

In addition, there is a brake assurance control 128, which is related to the operation of the brake signal train line 141 and responds when additional brake effort is requested in relation to a brake assurance deceleration sensing unit carried by each car. The brake assurance driver control 128 goes through the interface circuit 142 and drives the brake assurance train line 147, which then tells each car it should be in brake operation. There is a brake assurance equipment on each car, which determines whether or not the car is getting enough brake effort, and this is another vital interface. The P signal line 139 tells each car how much traction effort is desired, either positive or negative, and the brake signal line 141 tells each car whether it should be in propulsion or brake. The brake assurance train line 147 tells each car brake assurance equipment to start measuring the brake operation, and the brake assurance equipment on each car senses that the train control has requested the train to be in brake and therefore the brake assurance unit determines if its own car is getting enough brake and if not, it applies the emergency brakes for that car.

The speed commands in the roadway track signal blocks are received from currents in the rail in front of the lead car of the train, so it is believed that the dual track signal antennas 98 shown in FIG. 5 should be provided out in front of the train, however it should be understood that the here described handback control system is operative with a single track signal antenna 98 and a single track signal preamp 120 if desired. These signals are then routed to dual track signal preamps 120. In accordance with the teachings of the present invention the track signal is picked up with the front end antennas 98, which are dual antennas for the purpose of handback to provide the desired availability and reliability consistent with the here provided handback apparatus. The provision of the handback function for controlling a train of transit vehicles in general is believed to increase substantially the availability of the train control equipment, for example, by a ratio of 10 or 20 to 1, so it is believed necessary to increase the availability of this individual track signal antenna function which otherwise cannot be handed back because of its critical nature and the unique availability of the track signals in front of the train, and this is done through the provision of dual track signaling preamps and antennas. They are connected in parallel through a selected OR circuit, and the ATC equipment control computer is programmed to select one or the other antenna and its associated preamp. The dual track signal preamps 120 then take the speed command output and feed it to the track signal interface circuit 136 in a vital manner because the track signals are a vital function. If normal train control operation is requested, the track signal interface circuit 136 on the front car routes the track signals into the ATC equipment 116 on the front car for normal speed decoding. If the handback operation is requested, the track signal preamp 120 provides an output signal that is fed straight through the track signal interface circuit 136 on the front car to the track signal train line 137 going to the ATC equipment 116 in the rear control car, where the corresponding interface apparatus 136 receives the track signals from the train line 137 and provides these to the rear ATC equipment 116 for automatic handback operation. This routing is done by the track signal interface circuit 136 provided in each of the front A control car and the rear A control car.

The program stop operation also can be handed back to keep an individual train moving faster through a transit system. The approach of a train to a passenger station and the stopping of the train at the desired position in the station has a great influence on the actual system headway, and the program stop operation stops the train in the minimum possible time consistent with ride comfort and passenger quality constraints. An operator, if he were to take over this function in a fully automatic system, would bring the train into the station at a slower speed and lose valuable seconds of time in system headway. When a transit system is operating at 60 or 70 or 80 second headways between trains stopping at a given passenger station, just a few seconds of delay can cause following trains to substantially slow down, so the program stop system operation can also be handed back to the rear ATC equipment to improve the movement of a train as desired. For many reasons the rear program stop antennas on the rear control car are not used such that a handback of the program stop signals from the front control car is desired, and this includes the need to sense from the front of the train where the front of the train is positioned in the passenger station. Since the program stop function can be handled by the operator at a slight and acceptable reduction of system headway, it is not considered necessary to provide more than one program stop preamp 122 and more than one antenna 123. Thusly, the program stop preamp 122 is a single signal amplifier that sends the program stop information for a handback operation through the program stop interface circuit 138 on the front car selectively to the front ATC equipment 116 and the multiplex train line apparatus 114 on the front car which then sends the information down the multiplex train line equipment 115 to the rear control car or to the rear ATC equipment 116 by the program stop train line 150. When the program stop information is picked up at the front control car of the train and is sent to the rear control car under handback, the rear ATC equipment 116 then controls the speed of the train through the P line 139 and the brake line 141 from the rear control car as was previously explained for the apparatus shown in FIG. 5. The operator input 143 to the handback control apparatus 144 is from the operator's consule key switch to be later described. The output 146 represents the signals from several relay contacts within the handback control apparatus 144 that are operative in each of the interface units 130, 132, 134, 138, 140 and 142, as will be later explained.

Figure 6:
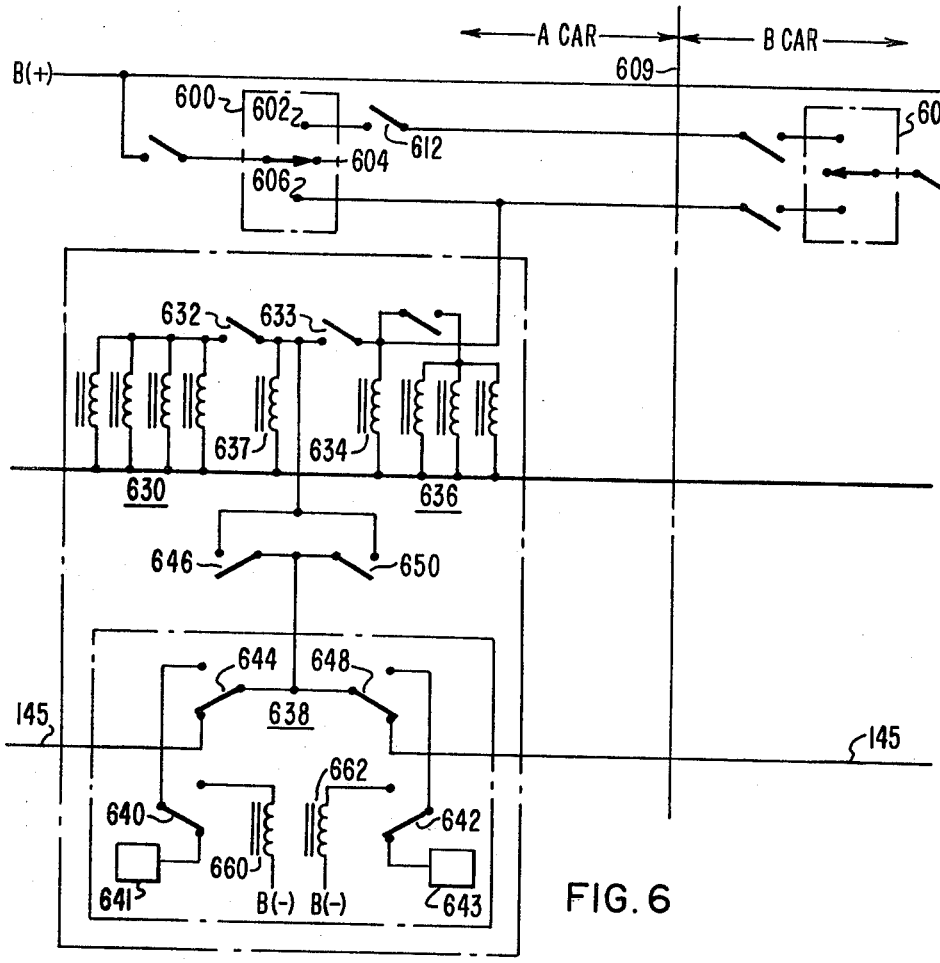
FIG. 6 shows the manual cab signalling handback interface circuits provided for each pair of A and B cars.

In FIG. 6 there is shown part of the handback control apparatus 144, including the handback selection circuits. The apparatus shown in FIG. 6 is physically part of the handback control apparatus 144 shown in FIG. 5, other than the car coupler contacts 644, 646, 648 and 650, the operator's console key switches 600 for the A car and 608 for the B car of the each married or coupled pair of cars A and B. The operator controller key switch 600 in car A includes a contact 602 for manual backup operation which is well known to utilize the third power and brake generator 126 to control the train lines 139 and 141 and disables the brake assurance on selected cars to get a train off the roadway track, a contact 604 for automatic train control operation from the front control car and a contact 606 for handback operation in conjunction with the rear control car. The operator key switch 600 is controlled by the operator when the A control car in the front of the train is the lead car, and the similar key switch 608 is operated when the B car in front of the train is the lead car of the train. The apparatus to the left of line 609 is located for convenience and availability of space reasons in the A car and the apparatus to the right of line 609 is located in the B car of each of the A and B pair of cars. The key switch 600 energizes the handback operation with the contacts 606. In the front control car when the handback contact 606 is closed by the master controller 600 power goes through the local handback relay 634 which closes the local handback switches 633 and 635 to energize the local handback relays 636, the handback train line 145 and the handback relay 637 which closes the handback switch 632, and the switch 632 energizes the handback relays 630.

In the rear control car, the power in handback comes from the train line 145 up through the closed coupler contracts and then energizes the handback relay 637 which closes the handback switch 632 and energizes the handback relays 630. When the handback contact 606 is closed, this energizes the local handback relays 634 and 636 to distinguish the front control car and the rear control car. In the rear control car the handback relays 630 and 637 only are energized to indicate that rear control car is in handback, while in the front control car both the local handback relays 634 and 636 and the handback relays 630 and 637 are energized to indicate that the front car is in handback and that it is a head end control car. This operates the relay logic 638 for providing the desired direction steering of the tachometer signals and more specifically, energizes the handback train line 145. When the B car is the lead car in the front of the train, the handback line 145 shown to the left of FIG. 6 goes to the end of the train behind the A car. On the other hand, the handback train line 145 shown to the right of FIG. 6 is energized when the A car is the lead car and the handback line 145 goes to the rest of the train behind the B car shown to the right in FIG. 6.

The selection circuits shown in FIG. 6 are provided for each control car of the train. In relation to the A and B married pair of cars in the rear of the train, it is desired to select the tachometer from the leading car of that pair of cars at the rear of the train; more specifically, the conductor 640 is connected to control the tachometer 641 of the B car when the B car is in front of the A car in the rear married pairs of cars. On the other hand, the conductor 642 is connected to control the tachometer 643 of the A car when the A car is in front of the B car of the married pair of cars at the rear of the train. In the rear of the train the car coupler door that is shut identifies the rear car of the married pair of cars in the rear of the train; more specifically, if the A car is in the front of the B car at the end of the train, the car coupler contacts 644 and 646 will be raised whereas if the B car is the front of the last married pair of cars in the train, the car coupler contacts 648 and 650 will be raised.

Figure 12:
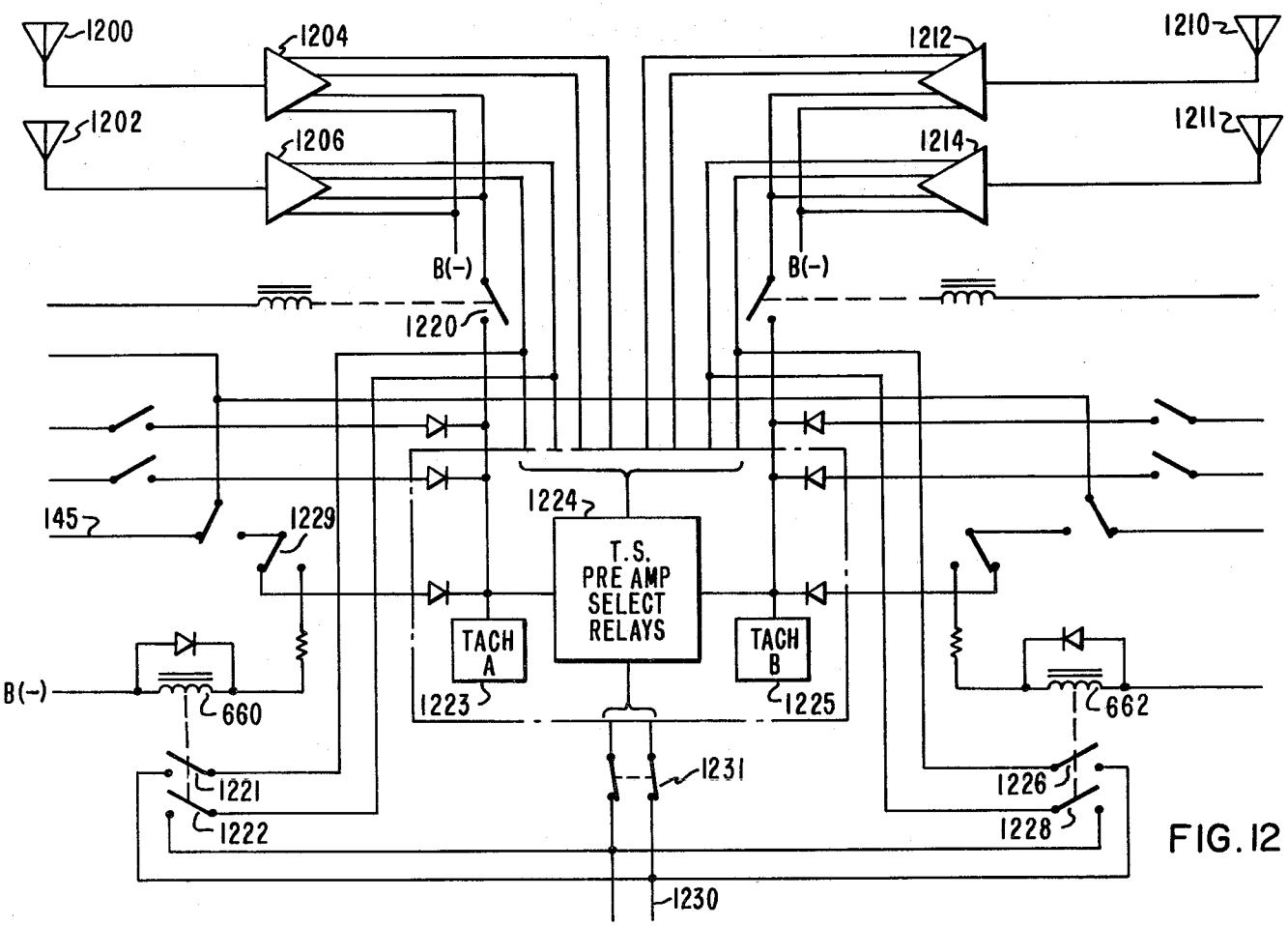
FIG. 12 shows the track signal preamp selection interface circuit with the ATC equipment provided for each pair of A and B cars.

At the front of the train, the front car antennas 98 and preamps 120 pick up the input speed command signals from the roadway track, with the A car antennas being operative with the A car preamps, and the B car antennas being operative with the B car preamps. The handback selection circuitry shown in FIG. 6 determines which of these signals from the A car or the B car will be used. For example, in FIG. 6 the relay winding 660 is energized in handback for this purpose when the A car is the lead car and the relay winding 662 is energized when the B car is the lead car at the front of the train. These same relay windings 660 and 662 are shown in FIG. 12.

The handback train line 145 shown in FIG. 6 extends to the left through car A and to the right through car B, for each A and B pair of cars in the train and to the end car couplers of each pair of those cars. Through operation of the handback train line 145, the rear pair of A and B cars has the handback relays 630 and 637 operated but not the local handback relays 634 and 636, as shown in FIG. 6. When the handback train line 145 is energized, the car coupler contacts determines which of the front pair of A and B cars is the lead car and the other car coupler contacts sends the handback signal on the train line 145 to the rear pair of A and B cars of the train and through each intermediate pair of A and B cars.

Figure 7:
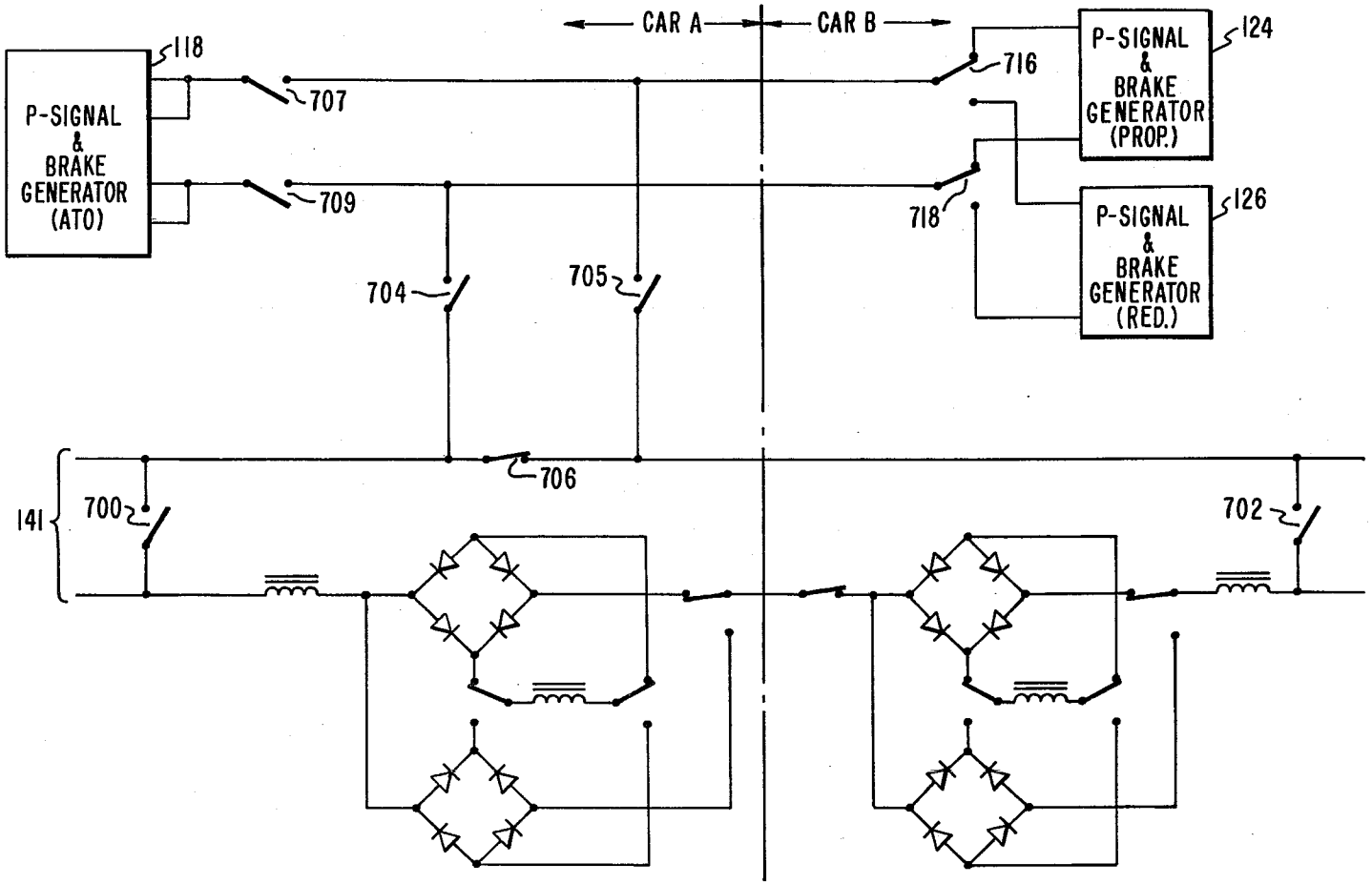
FIG. 7 shows the brake loop interface circuit in handback provided for each pair of A and B cars.

As shown in FIG. 7, the contacts 700 and 702 are car coupler contacts for the brake signal train line 141. When a given married pair of A and B cars is coupled to one or more similar married pairs of A and B cars, if the coupling is between the A car and a previous car ahead of the A car then the contact 700 is opened and if the B car is coupled to another car to the rear then the contact 702 is opened and the train line passes through this married pair of AB cars. Each married pair of A and B cars includes a power and brake interface circuit 140. The circuitry shown in FIG. 7 below and including the brake train line 141 is well known and was included in prior art transit vehicle control systems, such as described in the above referenced published articles. In normal train control operation, the relay contacts 704 and 705 are closed and the contact 706 is open in the front control car of the train for connecting the ATO P and brake generator 118 to the train line 141. In MCS handback, with the operator controlling the power and brake signals, the contacts 705 and 704 of the front car are closed and the contact 706 is open as determined by the handback control apparatus 144, with contacts 716 and 718 being raised to connect the front car P and brake generator 124 to the train line 141; in the rear control car the contacts 704 and 705 are open with contact 706 closed. When an overspeed condition occurs in normal control, the vital driver 680 shown in FIG. 18 operates to open contact 707. The contact 709 is closed by the operator controller for selecting ATO operation for the train. In automatic handback, the contacts 704 and 705 of the front control car are open and the contact 706 is closed, as determined by the handback control apparatus 144, and the brake signal is provided to the train line 141 by the rear control car. In the rear car in automatic handback, the handback contacts 716 and 718 are raised and the contacts 704 and 705 are closed to connect the P and brake generator 118 to the brake line 141.

Figure 8:
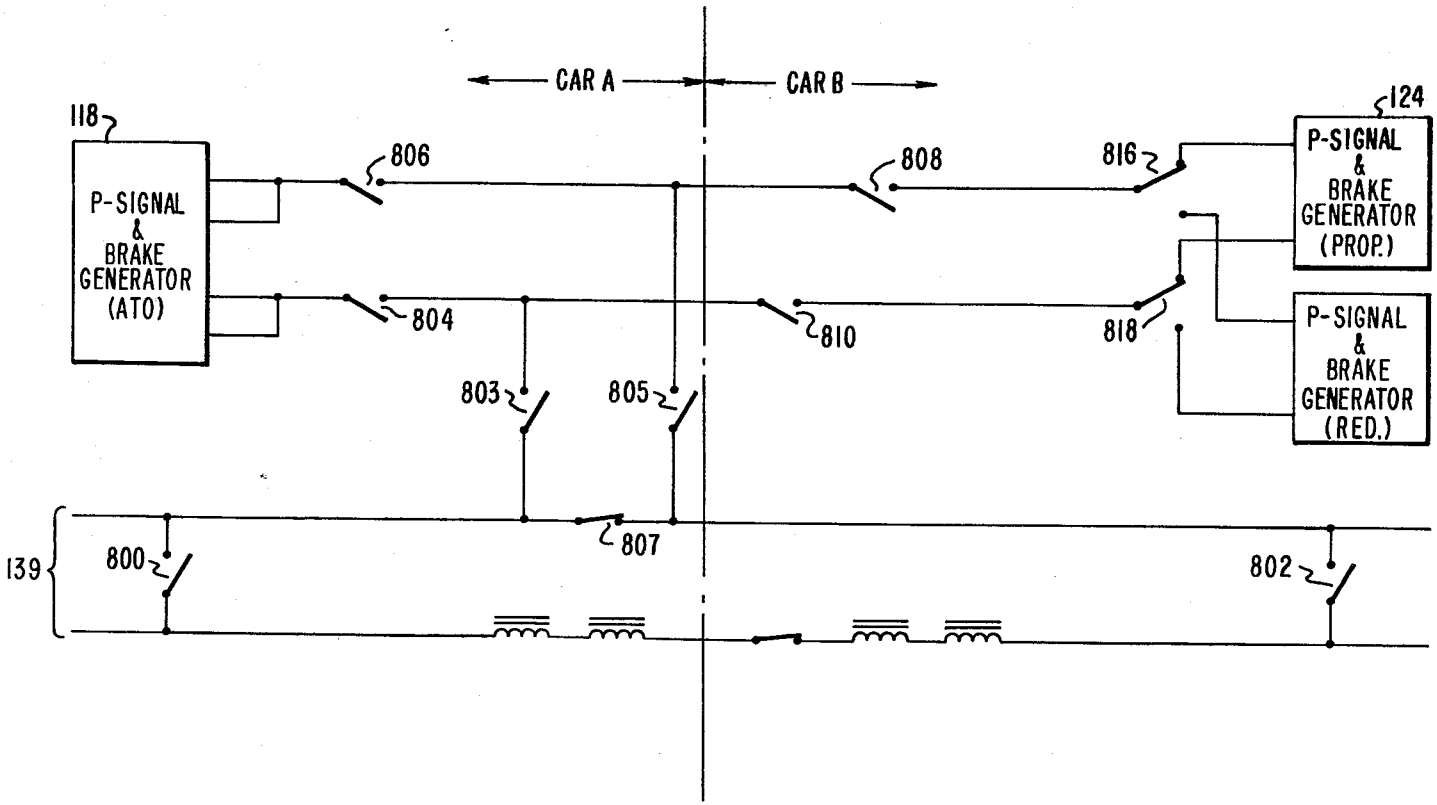
FIG. 8 shows the propulsion loop interface circuit in handback and provided for each pair of A and B cars.

In FIG. 8 there is shown another part of the power and brake interface 140, including the propulsion loop with handback operation. Like the car coupler contacts 700 and 702 shown in FIG. 7, the car coupler contacts 800 and 802 shown in FIG. 8 are open when coupled to another car, with the coupler on the front car end of the train and the rear car end of the train being closed and all others being open. For normal control of the vehicle train, the P and brake signal generator 118 of the front control car energizes the power train line 139 through the closed contacts 803 and 805, with contact 807 open and with contact 806 being closed by the operator controller. When an overspeed condition occurs in normal control, the ATO vital driver 680 in the front car shown in FIG. 18 operates to open the contact 804 to remove the P signal from the train line 139. In MCS handback, the contacts 803 and 805 of the front control car are open as shown in FIG. 8 and the contact 807 is closed, and the power train line 139 is energized by the P and brake generator 124 of the rear control car, with the contacts 803 and 805 in the rear car being closed. The handback relay 630 shown in FIG. 6 for the rear car raises contacts 816 and 818 to enable the rear car P and brake generator 124.

Figure 9:
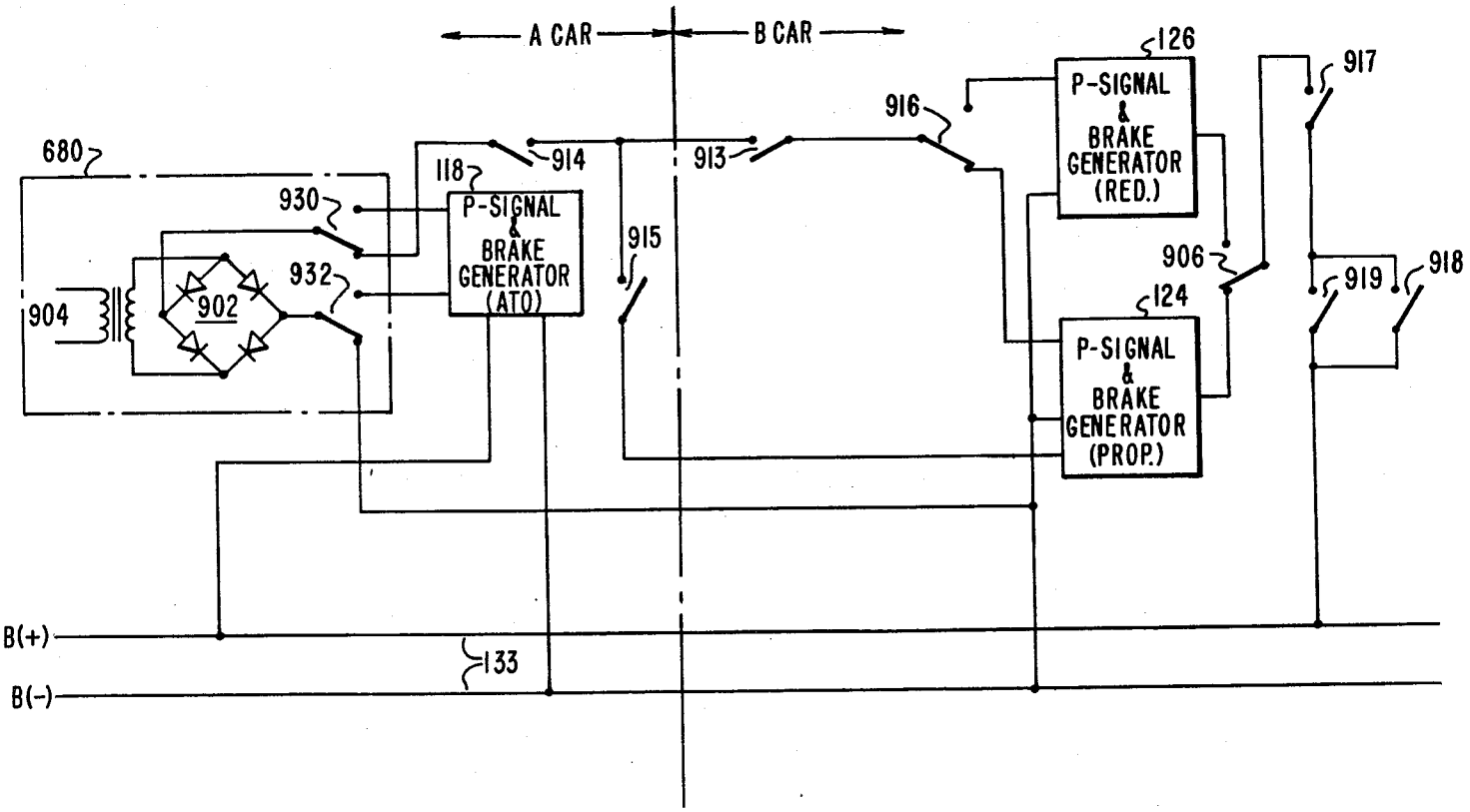
FIG. 9 shows the power feed interface circuit for the P and brake signal generators provided for each pair of A and B cars.

In FIG. 9, there is shown part of the ATC interface 134, relating to the power source connection and fast shut-off for the P and brake generators in handback operation. In normal ATO operation the traction request P signal in the front control car is applied to the diode bridge 902 through input 904 and then to the ATO P and brake signal generator 118 through the contacts 930 and 932 in the up position. Under MCS handback operation the diode bridge 902 through the relay contacts 930 and 932 in the down position applies the request P signal to the front control car MCS P brake generator 124. Under normal operation the front control car ATC equipment 116 supplies a P signal to the ATO generator 118 and in MSC handback the operator controller operates the MSC P signal generator 124. Under normal operation power is supplied to the generator 118 by battery voltage supplied on the front car. When operating in MCS handback mode this battery voltage power supplied to the MCS generator 124, which is in the front car, must come from the rear car ATC equipment 116, so a B+ train line 133 is provided and in FIG. 5 this train line is the fast shutdown train line 133. The B+ train line power comes from the rear car in MCS handback and is directed to the appropriate P and brake generator 124 in the front car and the other signals from the front car are disconnected. This operation is shown in relation to the ATC interface block 134 in FIG. 5 as the fast shutdown signal from train line 133 coming in the front car from the rear car, and then directed down to the MCS P signal and brake signal generator 124, which is shown in FIG. 9. So functionally the provided logic of interface circuit 134 turns the power on and selects which end of the train ATC equipment supplies the P or brake signal.

Figure 18:
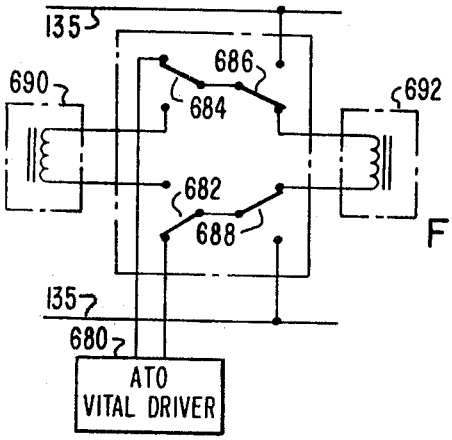
FIG. 18 shows the control operation provided in MCS handback for an overspeed condition of the train.

FIG. 9 shows the selection circuitry for controlling the application of power source feed and fast shut down to the P signal and brake generators and of the P signal to the P signal train line. For normal automatic control operation using the front car ATC equipment 116, the P signal and brake generator 118 in the front car has two fast shut-off inputs through the raised relay contacts 930 and 932. The input 904 receives the controlling input signal to enable the generator 118 from the vital driver within the ATC equipment 116 in response to vehicle actual speed in relation to the input command speed. The front car P signal generator 118 output goes to the power and brake interface 140 for providing a P signal to the train line 139. In the MCS handback, the rear control car ATC equipment 116 is operative with the front car OSRH relay 690 as shown in FIG. 18, and which front car overspeed handback relay 690 is operative with the contact 918 connected with the front car MCS P signal and brake generator 124. The overspeed contact 914 is open in MCS handback and power for enabling the front MCS P/brake generator 124 is applied by the train line 133 from the rear car ATC equipment 116, through the closed MCS contact 917, the overspeed handback contact 918, and the handback contact 906 to the front P/brake generator 124. The rear car receives the track signal speed commands and if an overspeed condition is sensed, it causes the front car handback overspeed relay 690 to open the contact 918 to remove power from the front car MCS P signal and brake generator 124. In the rear car during handback, the vital driver from input 904 gets onto the train line 133 through contact 930 in the down position and the closed overspeed contacts 914 and 915 to the rear P and brake generator 124 which is not active and feeds through handback contact 906 and MCS contact 917 and overspeed contact 919 to the top wire of train line 133. The contact 932 leads to the bottom wire of train line 133. This feeds a signal to enable the MCS P and brake generator 124 in the front car to put the P signal on the brake train line 139 as shown in FIG. 8 and to put the brake signal on train line 141 as shown in FIG. 7. If the front car ATC equipment 116 is controlling the whole train, the rear car OSR relay 919 and the rear car ATO vital driver 680 is disconnected and not operating. It is only in the MCS handback mode of operation that the rear car vital driver 680 will drive the front car OSRH relay 690, as shown in FIG. 18. The OSR contact 919 is used in the rear car when feeding the enable signal to the train line 133, and the OSRH contact 918 in the front car is closed in handback to feed the enable signal from the train line 133 to the P and brake generator 124 in the front car. The handback control apparatus 144 has relay coils to drive the handback contact 916.

Figure 10:
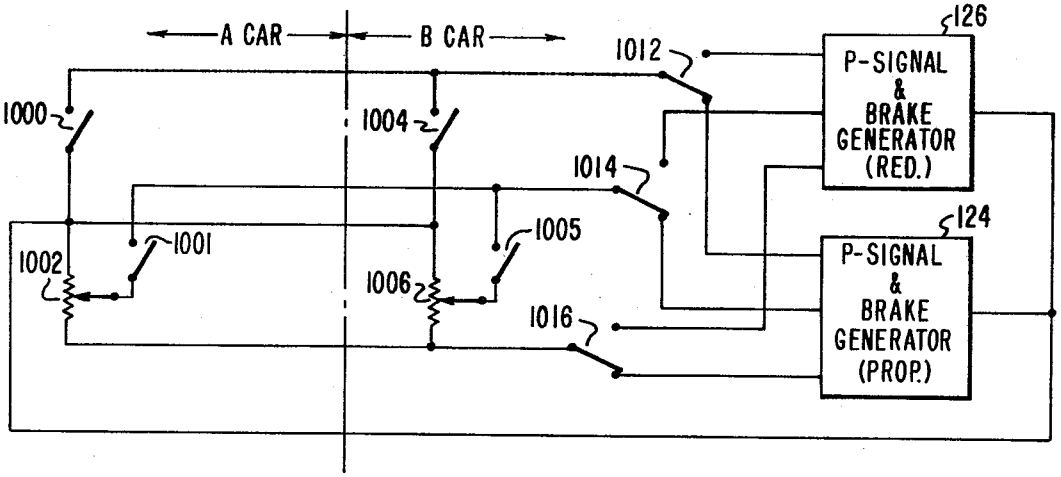
FIG. 10 shows the operator interface circuits for handback with the P signal generator provided for each pair of A and B Cars.

In FIG. 10 there is shown part of the handback control apparatus 144. The interface circuitry is shown for the manual cab signaling operation to get the operator control setting voltage, which is the P signal request signal into the front control car P signal and brake generators. The potentiometers 1002 and 1006 are part of the manual controller of the operator for the respective A car and B car, and are shown connected to the manual P signal and brake generator 126 and the MCS P signal and brake generator 124 through the handback contacts 1012, 1014 and 1016.

The potentiometers 1002 and 1006 with the associated contacts 1000 and 1004 are well known parts of the manual controllers and are operated by the operator. The handback contacts 1012, 1014 and 1016 are part of the handback control apparatus 144. The handback contacts 1012, 1014, and 1016 are raised to select the manual backup P and brake generator 126 and are lowered as shown to select the MCS P and brake generator 124. The operator in the front control A car closes contact 1000 and opens contact 1001 to apply the P signal request signal to the manual backup generator 126, and closes the contact 1001 and opens contact 1000 to apply the P signal request to the MCS generator 124. For a lead B car the operator contacts 1004 and 1005 are similarly operative. The contacts 1000, 1001, 1004 and 1005 are represented by the operator inputs 143 to the handback control apparatus 144 shown in FIG. 5.

Figure 11:
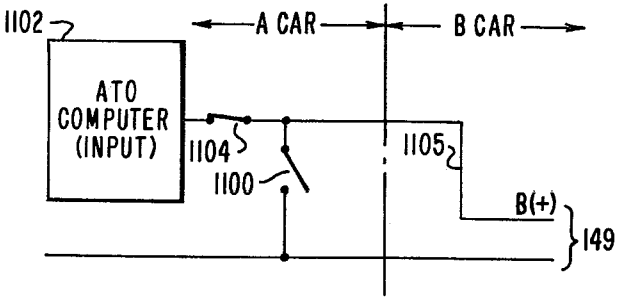
FIG. 11 shows the manual startup interface circuit that is used in handback provided for each pair of A and B cars.

In FIG. 11 there is shown the ATC interface 134 for the manual startup circuit, and this is used in MCS to defeat the safety circuits for a fixed time period in order for the train to start, and to tell the ATC equipment 116 that the operator has requested power and therefore the computer in the ATO equipment should start up to allow the train to move. Out of the ATC interface 134 is the MC 70 train line 149. When the manual controller in the front car has had a request given to it by the operator of greater than 70 percent power under MCS operation, this signal comes into the ATO equipment 116 in the front car and under normal operation enables the front car P brake generator 118 shown in FIG. 8 for a period of about 4 seconds. When in the handback mode, this MC 70 signal must again come from the operator controls in the front car but it is sent directly to the interface circuit 134 to tell the rear ATC equipment 116 that under MCS handback the operator is requesting power and that if everything is safe, the ATC equipment 116 in the rear car should start the train. For normal operation of the train, the start-up request passes through the closed local handback switch 1104 and the operator controller switch 1106 coupled to the B+ conductor 1105.

For handback operation, the local handback contact 1104 opens in the front control car and closes in the rear control car. The handback contact 1100 operates out of the handback control apparatus 144 and in handback operation is closed in the front control car so the ATO computer 1102 in the rear car receives the operators start up signal from the train line 149. The MC 70 train line 149, in response to a start-up signal from the operator input 143 to the handback control apparatus 144 of the front car is energized through the ATC interface circuit 134 to the train line 150 under handback to request train start-up propulsion power by the rear car interface circuit 134 and the ATC equipment 116 of the rear control car. In the rear car this start up signal from the train line 150 goes through the local handback contact 1104 that is closed by the handback control apparatus 144 in the rear car and causes the rear car ATO computer 1102 to temporarily energize the fast shut down train line 133 shown in FIG. 9 until tthe train gets started. If movement of the train is safe and other than a zero speed command is present in the occupied track signal block, the train will apply tractive effort power as directed by the rear car ATC equipment 116 for a predetermined time period such that the train can start moving.

The MC 70 train line 149 operation per se is well known with the prior art start-up time gate, such as described in U.S. Pat. No. 3,600,604 of G. M. Thorne-Booth, to remove the applied brakes on each vehicle car when the operator pushes his MCS control handle forward to remove the brake signal from the train line 141 and to release the brakes on each individual car. This MC 70 train line 149 puts in a dummy signal to the ATC equipment 116 for each married pair of vehicle cars to ignore the automatic train protection ATP circuitry within the ATC equipment for a predetermined time duration to permit the vehicle to respond to the P signal on the train line 139 and begin the desired propulsion tractive effort. After this predetermined startup time gate period, if there is no track signal violation such that the actual speed of the vehicles is not greater than the command signal from the occupied track signal block, the train of vehicles continues to move. Otherwise, the ATC equipment causes the individual brakes of the vehicle cars to again be applied.

In FIG. 12, there is shown the track signal interface 136. If A is the front control car, the relay winding 660 shown in FIG. 6 closes the contacts 1221 and 1222 in handback for apolying the speed command track signals from the A car antennas 1200 or 1202 to the track signal train line 137 shown in FIG. 13, and shunting these speed command track signals away from the normal track signal preamp select relays 1224. Similarly, if the B car is the control car at the front of the train, the relay winding 662 shown in FIG. 6 is energized to close the contacts 1226 and 1228 to shunt the B car speed command track signals around the track signal preamp select relays 1224 and to the track signal train line 137 going to the rear of the train. If the A car is the lead car at the front of the train, it is desired to use the A car antennas and not the B car antennas. The civil speed code in the form of the track signal speed command should be picked up at the nose of the train since the wheels of the lead car might otherwise short speed codes behind the nose of the train, and the power circuitry to the rear car preamps is broken and the output of the rear car preamps is open circuited by the interface circuitry 136 shown in FIG. 12, which relates to the track signal preamp selection, including the dual track signal preamp 120 shown in FIG. 5, the track signal interface circuitry 136 and to a limited extent the ATC equipment 116 because the track signals go to this ATC equipment. The dual antennas 1200 and 1202 and dual preamps 1204 and 1206 are shown for the A car. The dual antennas 1210 and 1211 and the dual preamps 1212 and 1214 are shown for the B car, because either one of the A and B cars can lead the train. In FIG. 5 only one set of antennas 98 and one set 120 of dual track circuit preamp are illustrated. The handback train lines 145 apply power through the indicated diodes up through the relay contacts 1220 to apply power to the A car two preamps 1204 and 1206. The power is applied to those preamps in several ways, such as if the A car is a front end car of the train. In handback the rear car ATC equipment 116 has to act like a lead car equipment because it is in control, but power cannot be applied to the preamps in the rear car of the train, so the contact 1220 in the rear car is provided to disable the preamps 1204 and 1206 when they are in the rear of the train. However, the head ATO or MCS signals come in through these diodes to activate the appropriate one of the tachometers 1223 and 1225 for the rear control car and the track signaling preamp select relays 1224.

Figure 13:
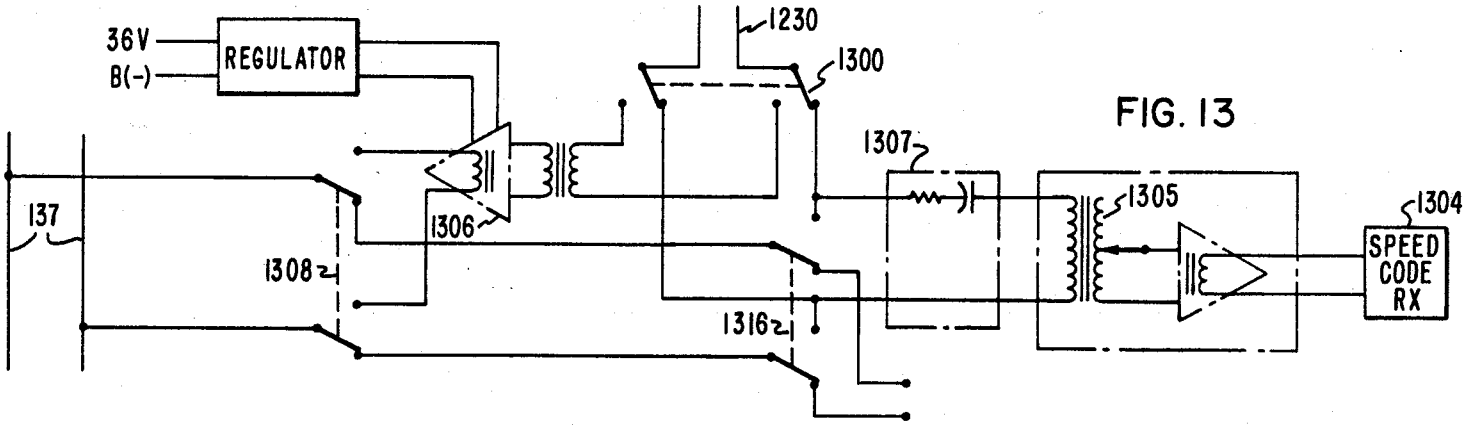
FIG. 13 shows the driver interface circuit for the track signal train line provided for each pair of A and B cars.

When not in handback the track signals from the front car preamps go to the select relays 1224 located in the front control car ATC equipment 116 and down through the line 1230 and the contacts 1300 as shown in FIG. 13 to the speed code receiver 1304 for the front car. The interface circuit 136 shown in FIG. 12 is continued in FIG. 13 to show the drive in handback for the track signal train line 137, with the line drive 1306 providing the power to drive about 700 feet of train line 137 in a very noisy environment. The clipper 1302, the multitap transformer 1305 and the filter 1307 is in the existing prior art ATC equipment for each control car. In handback, the track signals from the front car antennas are routed around the select relays 1224 by the contacts 1221 and 1222 operative with relay 6600 that is controlled by the local handback contact 1229 which closes in the front control car under handback for an A front control car and by the contacts 1226 and 1228 for a B front control car, and then routed through the line 1230 and handback contacts 1300 now thrown to the left, through the line driver 1306 and local handback contacts 1308 now up and then onto the train line 137 to the rear control car.

When the track signal interface 136 shown in FIGS. 12 and 13 is for the rear control car in handback, the track signals are picked from the train line 137 and go through local handback contacts 1308 in the down position as shown, through the handback contacts 1316 in the up position and to the speed code receiver 1304 for the rear control car. The handback contacts 1300 and 1316 are in the track signal interface 136 and are operated from the handback relays 630 shown in FIG. 6, while the local handback contacts 1308 and 1229 are in the track signal interface 136 and operate from the local handback relays 634 shown in FIG. 6. The local handback contacts 1308 are raised in the front control car to put track signals on train line 137 and dropped in the rear car to pick off these track signals from the train line 137 and route them to the speed code receiver 1304 in the rear control car.

Figure 14:
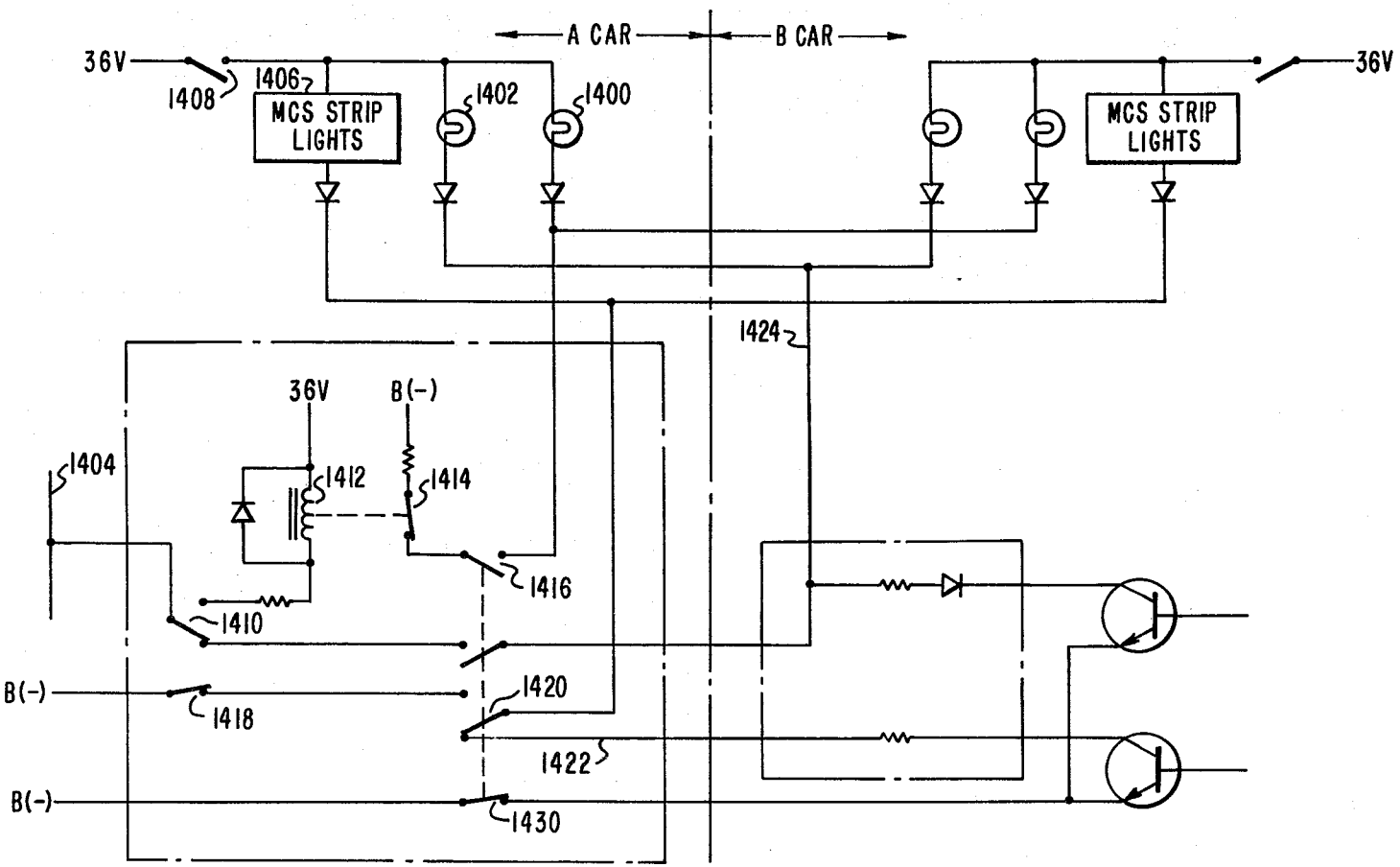
FIG. 14 shows the console display interface circuit for speed commands provided for each pair of A and B cars.

In FIG. 14 there is shown the display interface 132, including a modified version of the console display for speed commands. When in normal operation and not in handback, the operator in the front control car is given a display of the speed command signal on the console speed display 112 to indicate the control of the train by the front ATC equipment 116. In handback, from the rear of the train the decoded speed commands are supplied to the console display as a go or no go light indication to tell the operator in the front car that the train can go or the train cannot go in handback. For such an application, the go light 1400 is lit when there is a speed command signal operating the train or the 0 KPH no go light 1402 is lit in the absence of a speed command signal. These lights can be driven from the appropriate logic circuits and the 0 KPH train line 1404.

The local handback contact 1410 is picked up for the front control car in handback operation to sense if there is a speed command indication signal on train line 1404 from the rear control car, and this signal drives the relay 1412 to close contact 1414 and enable the go light 1400. The local handback contact 1416 is closed in the front car in handback by the handback control apparatus 144, so only the front car can enable the light 1400 in this way. When the train line 1404 is not energized in handback to indicate a no-go condition, the go light 1400 is not lit. There is an overspeed strip light 1406 indication in handback when an overspeed condition drops the contact 1418 to the position as shown to energize the strip lights 1406 through the handback relay contact 1420. When not in handback the strip lights are driven by suitable signals on conductor 1422 by the driver 1423 through the dropped handback contacts 1420, and the zero KPH light 1402 is driven by signals on conductor 1424 by the driver 1425. The local handback switch 1430 opens in the rear control car in handback operation to disable the drivers 1423 and 1425.

Figure 15:
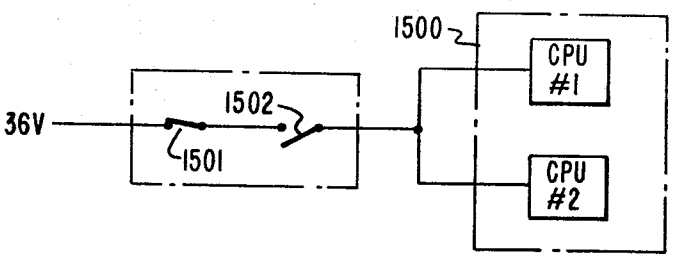
FIG. 15 shows the interface circuit provided to indicate the rear car ATC is in handback and should control the train.

In FIG. 15 there is shown the circuitry providing an input to tell the rear ATO equipment 116 when it is operating to control the train. In handback, the local handback contact 1501 is open in the front car and closed in the rear car, and the handback contact 1502 is closed in both the front and rear cars of the train. Thereby, in handback the rear car ATC computer 1500 is energized to control the train in response to tachometer signals, P signal generator enable signals and the like. The contacts 1501 and 1502 for this purpose are in the handback control apparatus 144 shown in FIG. 5.

Figure 16:
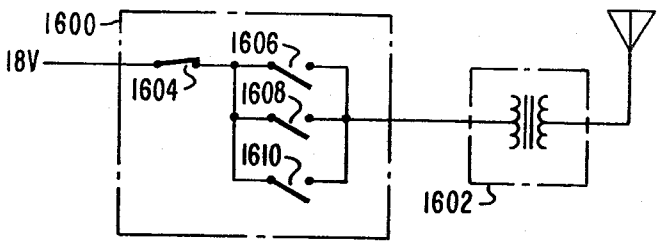
FIG. 16 shows the interface circuit controlling the front car ID transmitter from the rear car.

In FIG. 16 is shown part of the interface circuitry 134 which controls the ID transmit circuit. For normal operation, the front car ID transmitter is operative in the front of the train. When a handback operation is selected it is assumed that the front end ATC equipment 116 has failed, so the rear ID transmitter now is operative from the rear car and the ID information is transmitted from the rear car. The logic circuit 1600 is part of the handback control circuit 144 shown in FIG. 5, and it tells the ATC equipment 116 in the front control car to disable the front end transmitter 1602 by opening the local hand back switch 1604 in the front car, when in a handback operation. In the rear car this local handback switch 1604 will close to apply power to the rear car transmitter 1602 so the ID information is provided from the rear car. The contacts 1606 and 1608 are the A and B car contacts respectively and establish whether the A car or the B car is the front control car. The contact 1610 is a handback contact and provides a circuit in handback in the rear control car to energize the transmitter 1602.

Figure 17:
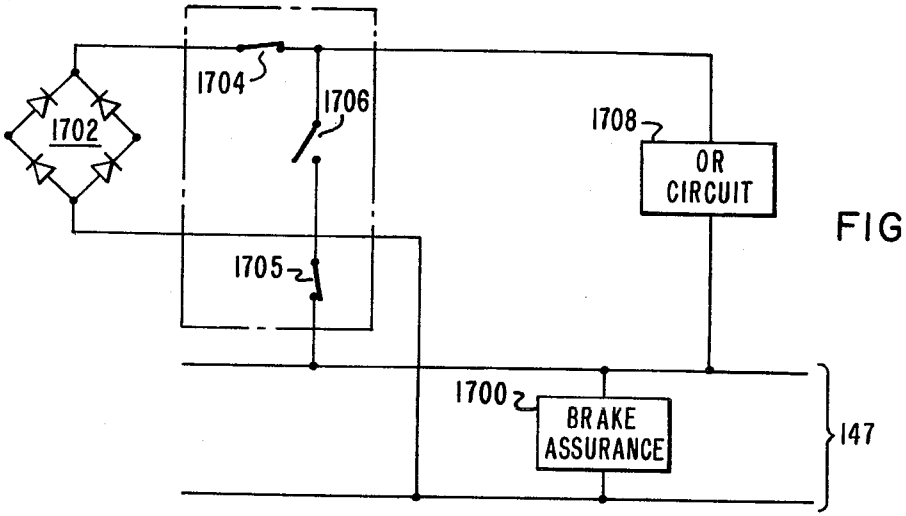
FIG. 17 shows the brake assurance interface circuit to energize the brake assurance line from the rear car.

The brake assurance interface circuit 142 shown in FIG. 17 operates with the brake assurance train line 147 and the brake assurance units 1700 of the individual cars. The rectifier 1702 which is an output of the vital driver in the brake assurance control 128 provides the power to energize the train line 147 for normal operation and when a front car is controlling the train that front car rectifier 1702 energizes the brake assurance train line 147. When the train control is in handback these brake assurance train lines 147 are energized from the rectifier 1702 at the rear of the train. The contact 1704 is operative with the local handback relay in the handback control apparatus 144, and in handback operation it is open in the front car and closed in the rear control car. The handback contact 1706 is closed in handback operation, so the rear control car rectifier 1702 output will then energize the brake assurance line 147 when desired by the train operation. If not in handback operation, the front car contact 1704 is closed to energize the train line 143 through the OR circuit 1708 and the rear car contact 1704 is open so the rear control car cannot energize the brake assurance train line 147.

There is included in the ATC interface 134 for each A and B pair of cars the ATO vital driver 680 shown in FIG. 18. The rear control car in MCS handback provides overspeed control for the front control car P signal generator and the brake signal for the train. The rear ATO vital driver 680 in handback passes a signal by the OSR train line 135 to the front car, where it is applied to control one of two overspeed relays. Thusly, in the rear control car the circuit shown in FIG. 18 includes the ATO vital driver 680 connected through the local handback contacts 682 and 684 in their position as shown and the handback contacts 686 and 688 in the position opposite to that shown in FIG. 18 for applying the ATO overspeed control signal to the train line 135. In the front control car and during handback each of these contacts is in its opposite position such that the control signal from the rear ATO driver 680 comes in off the train lines 135 and passes to the overspeed handback relay 690. When the train is not in the handback mode of operation, then the ATO vital driver 680 for the front car will control its own front control car overspeed relay 692 with the contacts in the positions as shown in FIG. 18. The overspeed relay is positioned in the enable loop for the P signal generator as shown in FIG. 8 and provides an overspeed control for the P signal generator 118. If there is no overspeed condition, the P signal generator 118 is enabled to provide a P signal output in response to a request for a desired tractive effort. In normal use, the front car overspeed relay 692 is in the enable loop for the front car P signal generator 118 operative with the ATC equipment 116 for its respective married pair of cars. In handback, the front car overspeed handback relay 690 is operative with the P signal generator 118 for the front car of the train such that the rear ATC equipment 116 is substituted for the normal front ATC equipment 116 and the rear car gets the track signal speed command signals and compares these with the actual speed of the train and if an overspeed condition is sensed, the rear ATC equipment 116 sends a signal through the overspeed relay train line 135 to the front car overspeed handback relay 690 to not provide the enable and in this way disables the P signal generator 118 for the front control car.

Figure 19:
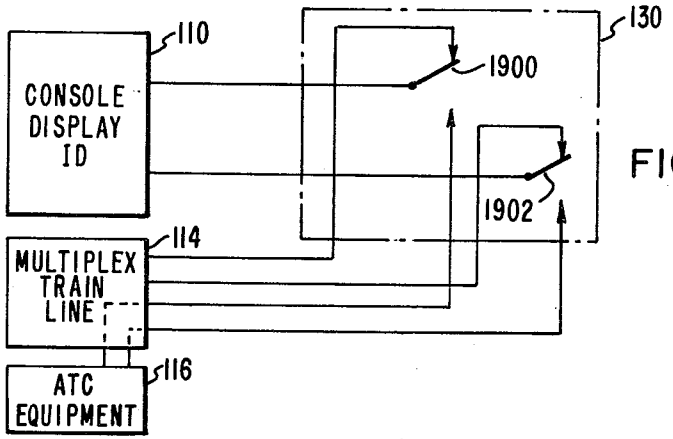
FIG. 19 shows the ID display interface.

In FIG. 19 there is shown the display interface 130 coupled with the multiplex train line apparatus 114. The multiplex train line apparatus 114 receives the input from the handback control apparatus 144 and then drives the console display 110 through the display interface 130. The source of the display information can come from the multiplex train line apparatus 114 through handback contacts 1900 and 1902 in their up position in handback or it can come from the ATC cabinet 116 through the handback contacts 1900 and 1902 in the down position when the front car is normally leading. Likewise, information sent back from the display 110 can go to the multiplex train line apparatus 114 in handback, which sends it to the rear end of the train or in normal front control car operation it can go to the front control car ATC equipment 116. The handback switches 1900 and 1902 provide the required selection between the multiplex train line apparatus 114 and the ATC equipment 116.

Figure 20:
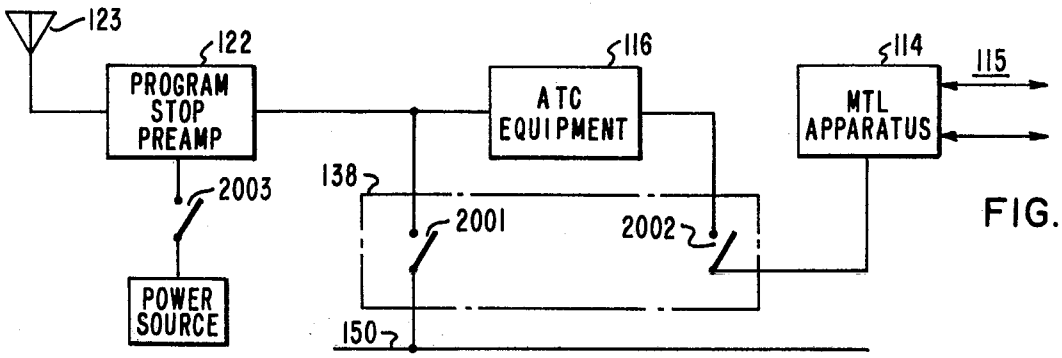
FIG. 20 shows the program stop interface.

The program stop interface 138 shown in FIG. 20 enables the program stop preamp 122 in normal operation to send the program stop information to the front control car ATC equipment 116. In handback, in one embodiment, the contact 2001 is closed to send the program stop information through the program stop train line 150 to the rear end of the train in addition to the front car ATC equipment 116. In handback, in a second embodiment of the present invention, the preamp 122 sends the program stop information through the contact 2002 from the front control car ATC equipment 116 and transfers it to the front car multiplex train line apparatus 114 and the train line 115 which sends that non-vital program stop data in the form of the number of crossover counts for each of predetermined time periods down the multiplex train line 115 to the other multiplex train line apparatus 114 at the rear control car which then delivers it to the operating ATC equipment 116 of the rear control car of the train. The contact 2003 is operative with the front control car operators controller key switch 600 to select the front car preamp 122 to be energized for the program stop control of the train. For the above first embodiment in handback, the program stop crossover signals from the program stop preamp 122 go through the front car program stop interface 138 and through the program stop train line 150 to the program stop interface 138 and the ATC equipment 116 of the rear control car for controlling the program stop operation of the train. For the above second embodiment in handback, the program stop information obtained at the front of the train has to be processed by the front control car multiplex train line apparatus 114 and made suitable for passage through the multiplex train line 115 to the train control system at the rear of the train.

The prior art program stop operation, such as described in the above referenced patent application Ser. No. 920,318, provided an interrupt for every six inches of the program stop wayside tape which the front end of the train passed over, and there was subtracted six inches from the provided distance-to-go table for each such interrupt. In accordance with prior art multiplex train line operation described in the above referenced patent application Ser. No. 920,043, now abandoned the multiplex train line computer 44 at the front end of the train counted the interrupts from passing the tape crossovers, and fifty-four times each second a count indication was sent over the multiplex train line 115 to the MTL computer at the rear of the train, which indication gave the number of tape crossover interrupts that occurred during each 1/54 second of time; at the maximum train speed, three cross-over interrupt counts can occur in 1/54 second of time, so the count indication can be any of zero, one, two or three, depending upon the speed of the train carried program stop antenna relative to a portion of the program stop tape under the front of the train.

Figure 21:
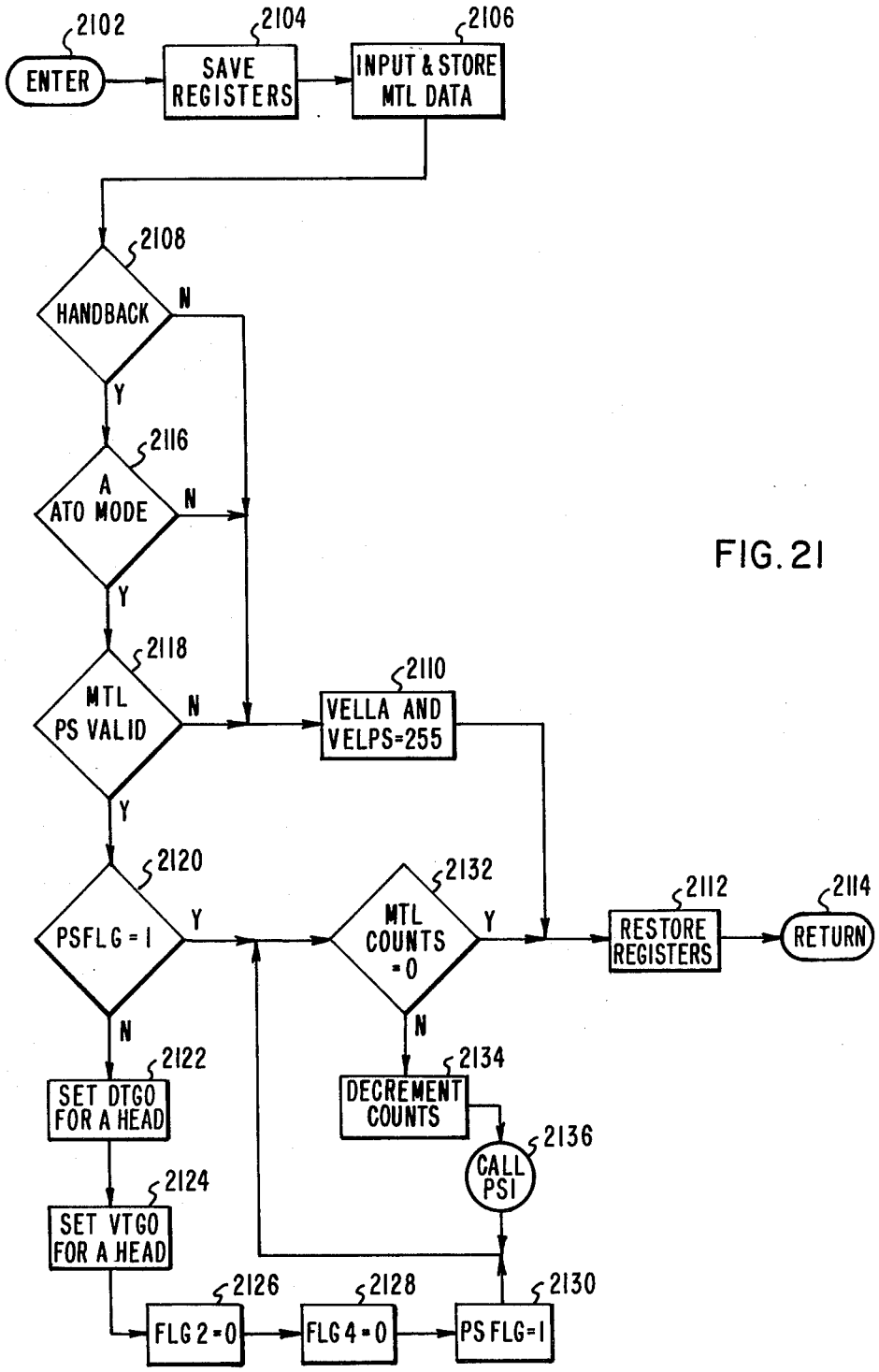
FIG. 21 shows a flow chart of the handback program stop (PS) control program that is provided with the regular PS control program.

The control program shown in FIG. 21 is provided as a part of the regular control program for the computer 42 in the ATC equipment 116 for each A and B pair of cars to determine the handback program stop operation for a train including that pair of cars. In handback and for the rear control car, the control program shown in FIG. 21 keeps track of the crossover counts and responds to each count indication from the multiplex train line 115 to go through the main program stop program disclosed in the above-referenced application Ser. No. 920,318 now U.S. Pat. No. 4,208,717 for each crossover interrupt sensed by the program stop antenna.

In FIG. 21, the program stop handback control program for the computer 42 in each ATC equipment 116 is entered at block 2102 at each output signal from a 54 hertz clock, for as long as the program stop control system is turned on and operating. At block 2104 the registers are saved. At block 2106 the program stop count data sent from the front of the train over the multiplex train line 115 is input. At block 2108, a check is made to see if the train operator has closed his handback selection switch to see if the handback mode of operation is requested by the operator. If not, which would occur for the normal train movement along the roadway track, at block 2110 the look ahead velocity and the program stop velocity are set to maximum. The above cross-referenced patent application Ser. No. 920,318 now U.S. Pat. No. 4,208,717 discloses the function of this look ahead velocity and the program stop velocity for controlling the train of vehicles. At block 2112 the registers are restored and the program ends at block 2114. If at block 21-8 the operator had selected the handback mode of operation for controlling the train, at block 2116 a check is made to see if an A car is the lead car at the front of the train, because the program stop antenna 104 is carried by the A car for the example shown in FIG. 4. At block 2118 a check is made to see if there is a program stop valid signal provided when an active program stop signal is received from the program stop tape beneath the front end of the train. If there is no program stop valid signal at block 2118, the program goes to the exit block 2114 as previously explained. At block 2120 a check is made to see if the program stop flag is set to one. For the first pass through this program the program stop flag is zero, so at block 2122 the distance-to-go table is set for an A car head end; at block 2124 the velocity-to-go table is set for an A car at the head end of the train. At block 2126 the table divider FLG 2 is set to zero, and at block 2128 the table divider FLG 4 is set to zero. At block 2130 the program stop flag is set to one, so block 2120 will now prevent coming through the same path again for this particular 1/54 second interrupt time period. At block 2132, a check is made to see if the counts from the multiplex train line equal zero, which indicates the number of tape crossovers that the train has passed since the last 54 hertz interrupt was received. If the count is zero, the program exits through blocks 2112 and 2114. If the count is not zero, at block 2134 the count number is decremented by one and in block 2136 the regular program stop routine is called, which regular program routine is described in the above-referenced patent application Ser. No. 920,318 now U.S. Pat. No. 4,208,717. After the regular program is run, at block 2132 another check is made to see if the count is zero and if not, whatever additional passes that are necessary are made through the blocks 2134 and 2136 until the number of counts reaches zero. The operation provided by the program shown in FIG. 21 is handback selected by the operator when the train is running in one of ATO or MCS operation. It will be readily apparent to persons skilled in this art that this selection to go into the handback mode of operation could be made by an automatic operation such as a computer diagnostic program sensing a failure of the front end ATC equipment, instead of the here-described operator selecting handback because he sees the train slowing down when it should not do so and selecting the handback operation by a suitable manual switch.

The program stop receiver within the ATC equipment 116, in accordance with the disclosure in the above referenced patent application Ser. No. 920,318, now U.S. Pat. No. 4,208,717 determines for the first sensed crossover signal that the program stop is active and for the second sensed crossover that the program stop is valid, and outputs three signals i.e., the PS active, the PS valid and an output for each crossover sensed by the antenna 123. The program stop control program included in that patent application is operated with the computer 42 shown in FIG. 1 of the ATC equipment 116 within the front control car to control the desired stopping of the train in accordance with predetermined velocities that are provided in storage tables and for every crossover signal the program selects a velocity for the train that is one step down a particular storage table.

The multiplex train line control program disclosed in the referenced patent application Ser. No. 920,043 now abandoned operates with the MTL computer 44 shown in FIG. 1 to count the crossover interrupt signals and develops the number of crossover signals during each 1/54 second. This number of crossover signals, the PS active and the PS valid are sent through the multiplex train lines 155 to the rear control car multiplex train line apparatus 114 and the rear ATC equipment 116.

In normal program stop operation, without handback being selected by the operator's key switch 600 shown in FIG. 6, the front control car ATC equipment 116 including the regular program stop control program disclosed in patent application Ser. No. 920,318 now U.S. Pat. No. 4,208,717 is operative to provide the desired control program stopping of the vehicle train. The program stop information sent to the rear control car over the multiplex train line 115 is ignored.

In handback program stop operation, with handback being selected by the operator's key switch 600 and with contact 2002 being closed and contact 2001 in FIG. 20 being open, the rear control car ATC equipment 116 including the regular program stop control program and the additional program stop handback control program in accordance with FIG. 21 is operative to provide the desired stopping of the vehicle train, and the program stop information sent to the front control car ATC equipment 116 does not control the desired stopping of the vehicle train, since only in handback the rear car ATC equipment 116 is connected through the power and brake interface to energize the power train line 139 and the brake train line 141. In handback program stop operation, with handback selected by operator's key switch 600 and contact 2002 open and contact 2001 closed, the rear control car ATC equipment 116 including the regular program stop control program, without the use of the additional program stop handback control program shown in FIG. 21, is operative to provide the desired stopping of the vehicle train, and the front control car ATC equipment 116 does not control the stopping of the vehicle train.

Figure 22:
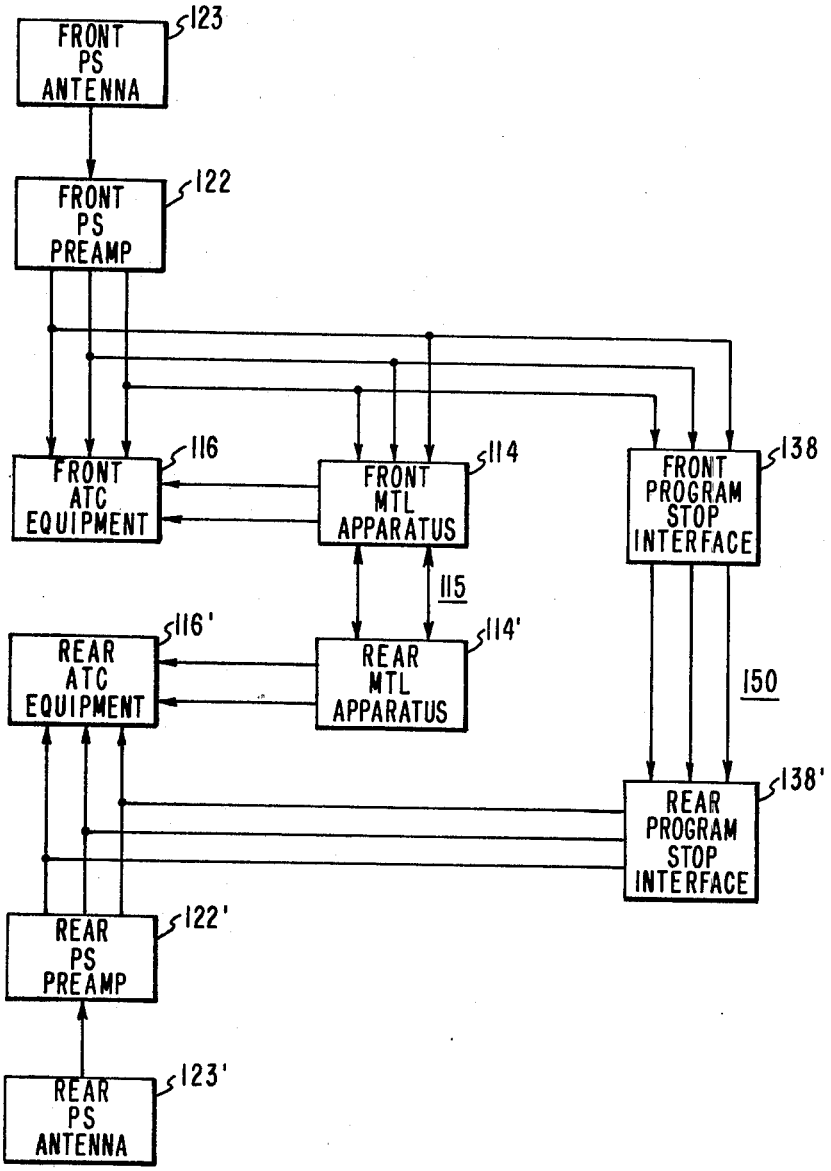
FIG. 22 shows the operational PS control apparatus relationship of the front ATC equipment and the rear ATC equipment.

In FIG. 22 there is illustrated the operational program stop control apparatus relationship of the front ATC equipment and the rear ATC equipment for controlling the train of vehicles. The front car pair PS preamp 122 receives the program stop crossover signals from the front PS antenna 123. The PS receiver provides three outputs, the PS active, the PS valid and the crossover signals, to the front ATC equipment 116. The front MTL apparatus 114 responds to these same three signals to output to the multiplex train line 115 the MTL valid and the crossover count signal each 1/54 second. If normal operation without handback is selected by the operator's key switch, the front ATC equipment 116 controls the train, and the front MTL apparatus 114 sends output signals to the rear of the train but there is no train control response to these signals. If handback operation is selected by the operator's key switch 600 and the contact 2002 shown in FIG. 20 is closed, the front ATC equipment 116 does not control the train in response to the three PS active, PS valid and crossover signals, and the rear ATC equipment 116 responds to the PS valid, and crossover count signal each 1/54 second from the rear MTL apparatus 114 in accordance with the program flow chart shown in FIG. 21 to control the train stopping velocity for each incremental movement of the train along the provided program stop transmitting antenna positioned along the roadway as previously described in reference patent application Ser. No. 920,318 now U.S. Pat. No. 4,208,717. The program stop control apparatus shown in FIG. 22 will operate to provide the here described handback operation with the train going in one direction with the illustrated front car pair ATC equipment 116 in normal control of the train or going in the other direction with the illustrated rear car pair ATC equipment 116' in normal control of the train. If handback operation is selected by the operator's key switch 600 and the contact 2001 shown in FIG. 20 is closed, the crossover signals are sent to the rear ATC equipment 116 through the PS train line 150 and the rear program stop receiver operates with the regular PS control program to determine the stopping velocities for the train.

Figure 23:
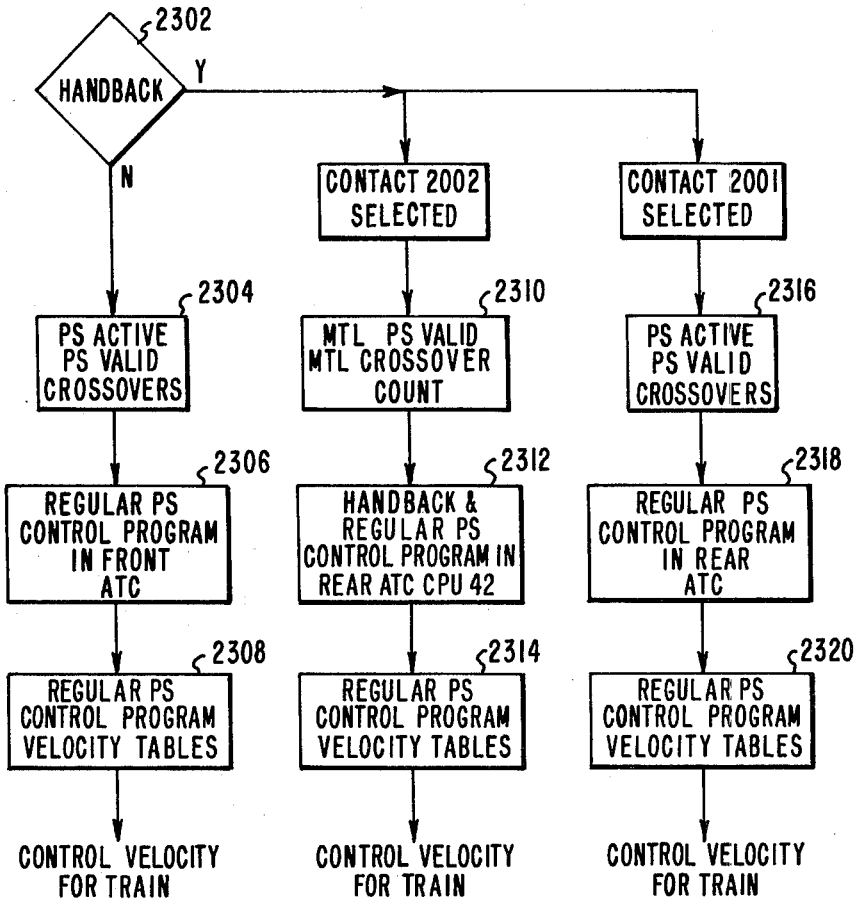
FIG. 23 shows a functional outline to illustrate the operation of the program stop (PS) control apparatus of FIG. 22.

In FIG. 23, there is provided a functional outline to illustrate the operation of the program stop control apparatus shown in FIG. 22. The operator selects handback or not by his key switch 600 shown in FIG. 6. If handback is not selected at 2302, then the front program stop receiver provides the PS active, the PS valid and the individual crossover signals 2304 that are operative with the regular program stop control program in the front ATC equipment 2306, including the regular program velocity tables 2308 to determine the stopping velocities for the train. If handback is selected at block 2302 and the contact 2002 shown in FIG. 20 is closed to provide the multiplex train line operation, then the front MTL apparatus 114 sends the PS valid and the crossover count 2310 through the rear MTL apparatus 114' to the rear ATC equipment 116'. The rear ATC equipment 116' includes the handback control program shown in FIG. 21 and the regular PS control program 2312, and is operative with the regular PS program velocity tables 2314 to determine the stopping velocities of the train. If handback is selected at 2302 and the contact 2001 shown in FIG. 20 is closed, then the PS active, the PS valid and the individual crossover signals 2316 sent to the rear program stop receiver which provides the PS active, PS valid and crossover signals for operation with the regular PS program in the rear ATC equipment 2318, including the regular velocity tables 2320 to determine the stopping velocities for the train.

The operation selection provided by the closing of contact 2001 or the closing of contact 2002 can depend upon the practical availability of enough train lines to include the program stop train line 150. If providing the train line 150 is a practical problem or not desired for some reason, then the contact 2002 can be closed to provide the handback operation through the MTL 115. If providing the train line 150 is not a practical problem or if the provision of the MTL apparatus 114 and associated train line 115 is not desired for cost or other reasons, then the contact 2001 can be closed to provide the handback operation through the train line 150.

In reference to the handback control system arrangement of FIG. 5, for a handback operation the program stop crossover data can go from the interface 138 on the program stop train line 150 to the rear control car ATC equipment or it can go from the interface 138 up to the front car PS receiver in the ATC equipment 116 and then to the multiplex train line apparatus 114 where it is processed as previously described in relation to 54 hertz interrupts and goes over the multiplex train line 115 to the rear multiplex train line apparatus 114 and the rear ATC equipment 116 for operation with the PS program routine of FIG. 21. For speed decoding the input speed command signals, for no handback go from the track signal interface 136 up to the front control car ATC equipment 116, and for handback go from the track signal interface 136 to the rear ATC equipment over the track signal train line 137. For the speed maintaining function, there is no interface signal and instead this function is done by the front ATC equipment 116 when not in handback and is done by the rear ATC equipment 116 when in handback to provide the required effort request P signal. The P signal control is performed by the ATO P/B generator 118 in automatic train operation by the ATC equipment 116, in the front control car when not in handback and in the rear control car when in handback. The overspeed control for ATO is performed in the front control car when not in handback and is performed at the rear in handback, as was explained in relation to FIG. 18; under MCS with no handback this is the fast shutdown of the front ATC equipment 116, and with MCS handback this is a signal between the rear ATC equipment 116 and the front ATO P/B generator 118. Under MCS handback the fast shutdown signal is developed in the rear ATC equipment 116 and passes through the rear ATC interface 134 and the fast shutdown train line 133 to the front ATC interface 134 for shutting down the front MCS P signal generator 124. The ID information is processed in the front ATC equipment 116 in ATO and MCS with no handback, and is done with handback in the rear ATC equipment 116 in ATO and MCS. The door control signals are not involved with the handback operation, since it is desired that both the front and rear ATC equipment be active for automatic control of the doors. The performance modification is done by the front ATC equipment 116 when not in handback and is done by the rear ATC equipment 116 for handback operation, picking up the performance modification signals from the ID antennas in the stations or terminal zones to modify the speed maintaining operation to output a modified P signal. The ID display is normally handled in the front ATC equipment 116, and in handback is handled by the rear ATC equipment through the multiplex train line 115 to the operator in the front of the train; if the operator updates the front car console display in relation to train length, destination or serial number in the front of the train, it goes through the multiplex train line 115 to the rear ATC equipment 116. The speed display in handback comes from the rear ATC equipment determined speed commands. The track signals start with the front end antennas 98 and in handback the signals from the front end antennas 98 are processed by the rear ATC equipment 116, with dual antennas and preamplifiers being used as shown by FIG. 12. The program stop signals come from antennas 123 at the front of the train, with the front ATC equipment 116 being used in response to each crossover interrupt without handback, and in handback selectivity the front multiplex train line apparatus 114 provides a crossover count indication to the rear ATC equipment for each of 54 hertz time periods or each crossover interrupt is sent through the train line 150 to the rear car. The ID signals in normal operation without handback operate with the front ATC equipment, and in handback they operate with the rear ATC equipment including both the ID transmitters, ID receivers and ID antennas.

The following table shows identified train control functions, where these functions are performed and where they are not applicable with and without the here described handback operation, for each of automatic train operation ATO by the ATC equipment 116, manual cab signaling MCS and manual control MAN by the operator.

TABLE I

| | No Handback | | | Handback | | |
|---|---|---|---|---|---|---|
| FUNCTION | ATO | MCS | MAN | ATO | MCS | MAN |
| Program Stop | Front | NA | NA | Rear | NA | NA |
| Speed Decoding | Front | Front | NA | Rear | Rear | NA |
| Speed Maintaining | Front | NA | NA | Rear | NA | NA |
| P Signal Control | Front | NA | NA | Rear | NA | NA |
| Overspeed | Front | Front | NA | Rear | Rear/ Front | NA |
| ID Information | Front | Front | NA | Rear | Rear | NA |
| Doors | Front | NA | NA | NA | NA | NA |
| Performance Modification | Front | NA | NA | Rear | NA | NA |
| ID Display | Front | Front | NA | Rear | Rear | NA |
| Speed Display | Front | Front | NA | Rear | Rear | NA |
| Track Signal | Front | Front | NA | Front and Rear | Front and Rear | NA |
| P Stop Signals | Front | NA | NA | Front | NA | NA |
| ID Signals | Front | Front | NA | Rear | Rear | NA |

For the handback control apparatus shown in FIG. 5, a correlation of the signals shown in Table I can be made. The handback train lines 145 carry control signals as previously explained in relation to FIG. 6. The multiplex train line 115 carries the program stop count indication for each of 54 hertz time periods, the ID display information and the speed display information. The zero KPH train line 1404 operates with the speed console display interface 132 to inform the operator a zero speed command signal is received from the roadway track and comes from the rear ATC equipment in handback, and as shown in FIG. 14 provides for the operator a go or no go display light in handback operation. The fast shutdown train line 133 shown in FIG. 9 and the overspeed train lines 135 shown in FIG. 18 operate with the ATC interface 134. The MC 70 train line 150 operates with the ATC interface 134 to provide a start-up temporary enable signal under handback from the front of the train to move a stopped train; if the rear ATC equipment indicates train movement is safe, the rear ATC equipment outputs the fast shutdown signal on the train line 133 and the overspeed control signal on the train line 135 depending upon when it is safe for the train to move.

The dual track signal preamplifiers operate through the track signal interface 136 and the track signal train line 137 to provide speed command signals to the rear ATC equipment in handback. The program stop crossover signals go through the program stop interface 138 to one of the multiplex train line 114 for providing a count indication for each 54 hertz period to the rear ATC equipment in handback or to the program stop train line 150 to supply each program tape crossover interrupt signal to the rear ATC equipment in handback, as previously explained. The power train line 139 provides the P signal control. The brake train line 141 provides the brake operation in relation to the P signal. The brake assurance interface 142 and the brake assurance train line 147 are provided for the purpose of determination by the ATC equipment responding to vehicle-carried accelerometers when the train vehicles are not decelerating as desired in response to a requested brake effort signal, by the P signal on the power train line 139 being below a predetermined value and a brake mode of operation signal being provided on the brake train line 141; when the overspeed signal indicates the train is ready to go, the brake assurance train line 147 is energized, and when the vehicle brakes are applied by the P signal and brake mode signal, the brake assurance signal on the train line 147 disappears. During the latter brake operation, the individual vehicle brake assurance units monitor the actual brake effort of the vehicles in response to the brake effort request, and if the proper brake rate is not obtained, the individual vehicle emergency brakes are applied.

In the Appendix there is included an instruction program listing that has been prepared to control the handback program stop operation of the here disclosed control program shown in FIG. 21. The instruction program listing is written in the assembly language of the Intel 8080 microprocessor. Many of these microprocessors have already been supplied to customers, including technical instruction manuals and descriptive documentation to explain to persons skilled in this art the operation of the microprocessor apparatus. This instruction program listing is included to provide an illustration of one suitable embodiment of the present invention that has been developed. This instruction program listing at the present time is a more or less development program and has not been extensively debugged through the course of practical operation for the real time control of a handback program stop operation. It is well known by persons skilled in this art that most real time control application programs contain some bugs or minor errors, and it usually takes varying periods of actual operation time to identify and routinely correct the more critical of these bugs.

HANDBACK FOR PROGRAM STOP
ENTERED FROM 54 HZ INT ROUT

```
ϕ94ϕ DB73     HBFS:  IN    73H
ϕ942 E6ϕ4            ANI   ϕ4H     ; IN HANDBACK
ϕ944 C299ϕ9          JNZ   HP53    ; NO
ϕ947 DB64            IN    64H
ϕ949 32FFϕE          STA   IN64    ; MTL PS DATA
ϕ94C 47              MOV   B,A     ; SAVE
ϕ94D E6ϕ4            ANI   4       ; MTL PS VALID
ϕ94F CA91ϕ9          JZ    HPS1
ϕ952 DB61            IN    61H
ϕ954 E6ϕ1            ANI   1       ; A ATO?
ϕ956 CA91ϕ9          JZ    HPS1    ; NO
ϕ959 3A37ϕE          LDA   PSFLG
ϕ95C B7              ORA   A       ; FIRST PASS?
ϕ95D C277ϕ9          JNZ   HPS2    ; NO
ϕ96ϕ 2AA6ϕ9          LHLD  ADTGO   ; YES,
                                      INITIALIZE
ϕ963 2232ϕE          SHLD  DTGO
ϕ966 2AA8ϕ9          LHLD  AVTGO
ϕ969 223ϕϕE          SHLD  VTGO
ϕ96C AF              XRA   A       ; ZERO FLAGS
ϕ96D 3239ϕE          STA   FLG2
ϕ97ϕ 3238ϕE          STA   FLG4
ϕ973 3C              INR   A
ϕ974 3237ϕE          STA   PSFLG   ; SET FIRST
                                      PASS FLAG
ϕ977 78       HPS2:  MOV   A, B    ; GET DATA
ϕ978 IF              RAR
ϕ979 IF              RAR
ϕ97A IF               RAR
ϕ97B E6ϕ7            ANI   7
ϕ97D 323AϕE          STA   CNTS    ; MTL NO. OF
                                      XOVERS
ϕ98ϕ CA99ϕ9   HPS4:  JZ    HPS3    ; ZERO COUNTS
ϕ983 3D              DCR   A       ; SUB 1
ϕ984 323AϕE          STA   CNTS
ϕ987 CD7Fϕ8          CALL  PS1     ; GO DO PS
                                      ROUTINE
ϕ98A 3A3AϕE          LDA   CNTS    ; GET
                                      REMAINING
                                      COUNTS
ϕ98D B7              ORA   A
ϕ98E C38ϕϕ9          JMP   HPS4
ϕ991 3EFF     HFS1:  MVI   A,255   ; NOT IN PS
ϕ993 3236ϕE          STA   VELLA
ϕ996 32ϕ9ϕE          STA   VELPS
ϕ999 C9       HPS3:  RET
ϕ99A CD7Fϕ8   FS1A:  CALL  PS1
ϕ99D C379ϕ8          JMP   P53
```

We claim:

1. In control apparatus for a train of vehicles operative with a roadway track and having at least a primary control vehicle and a secondary control vehicle, with each control vehicle including an automatic train control equipment, the combination of first means provided in said primary control vehicle for receiving a control signal from the roadway track, second means provided in each of said primary and secondary control vehicles, with the second means in said primary control vehicle being coupled with the first means in the primary control vehicle and providing an interface control connection between said primary control vehicle and said secondary control vehicle, third means provided in each of the primary control vehicle and the secondary control vehicle, with the third means in the primary control vehicle being coupled with the second means in the primary control vehicle for selecting either a normal operation with the primary control vehicle controlling the train or a handback operation with the secondary control vehicle controlling the train, with said second means including first signal means in each of the primary and secondary control vehicles and being energized in the primary vehicle for determining the secondary control vehicle to control the train for said handback operation, and with said second means including second signal means in each of the primary and secondary control vehicles and being energized in each of the primary and secondary control vehicles for enabling the secondary control vehicle to control the train for said handback operation.

2. The control apparatus of claim 1, with the first signal means being a local handback apparatus that is energized in the primary control vehicle and with the second signal means being a handback apparatus that is energized in each of the primary control vehicle and the secondary control vehicle.

3. The control apparatus of claim 1, with the third means energizing the first signal means of the primary control vehicle when a handback operation is selected.

4. The control apparatus of claim 1, including a train line between the primary control vehicle and the secondary control vehicle, with the first and second signal means in the primary control vehicle being energized by the third means, and with the second signal means in the secondary control vehicle being energized by the train line.

5. The control apparatus of claim 1, with each of the vehicles of said train including coupler contacts, and with said interface control connection passing through the closed coupler contacts between each adjacent pair of said vehicles.

6. The control apparatus of claim 1 for a train having an operator on said primary vehicle, with said third means being an operator controller having a first contact for selecting said normal operation and a second contact for selecting said handback operation.

7. The control apparatus of claim 1 for a train having an operator on the primary control vehicle, with said third means being a controller utilized by said operator in the primary control vehicle for selecting said handback operation by energizing the first signal means and the second signal means of the primary control vehicle.

8. In control apparatus for a train operating along a roadway track providing a control signal and having a first vehicle with a train control equipment and a second vehicle with a train control equipment, the combination of first means provided in each of said first and second vehicles and establishing a control connection between the first vehicle control equipment and the second vehicle control equipment, second means provided in each of said first and second vehicles and operative with the first means of the first vehicle for selecting either a normal train control operation with the first vehicle control equipment determining the operation of the train or a handback train control operation with the second vehicle control equipment determining the operation of the train, with said first means including first signal means in said first vehicle for establishing said control connection associated with said first vehicle and including second signal means provided in each of the first vehicle and the second vehicle and coupled with the first signal means in the first vehicle, with said first signal means in the first vehicle energizing said second signal means in each of the first and second vehicles for establishing said control connection associated with each of the first vehicle and the second vehicle.

9. The control apparatus of claim 8, with said first means including a switch apparatus provided in the first vehicle and coupled with said second means such that the first signal means establishes a first control connection for said control signal in the first vehicle and the second signal means establishes a second control connection for said control signal in each of the first vehicle and the second vehicle.

10. The control apparatus of claim 8 for a train having an operator, with the second means being an operator controller apparatus including a first contact for selecting the train control equipment of the first vehicle to determine the operation of the train when the normal train control operation is desired and a second contact for selecting the train control equipment of the second vehicle to determine the operation of the train when the handback train control operation is desired.

11. The control apparatus of claim 8, with the first signal means establishing a first control connection for the train control equipment of the first vehicle and with the second signal means establishing a second control connection for the respective train control equipments of the first vehicle and the second vehicle.

12. In the method of controlling a train of vehicles operative with a roadway track providing a control signal with said train having at least a front control vehicle and a rear control vehicle that each have a train control equipment, the steps of sensing the control signal associated with the front control vehicle for determining the operation of the train along said roadway track, controlling said train with the train control equipment of a primary control vehicle in response to said control signal for a normal control operation of said train, controlling said train with the train control equipment of a secondary control vehicle in response to said control signal for a handback control operation of said train, providing a first signal circuit in the primary control vehicle for establishing said handback control operation of the train, and providing a handback signal circuit in each of the primary control vehicle and the secondary control vehicle for enabling said handback control operation of said train.

13. The method of claim 12, with the primary control vehicle being in front of the secondary vehicle in relation to the movement direction of the train.

14. The method of claim 12, with the primary control vehicle an operator for providing said first signal circuit and said second signal circuit when the second control operation is desired.

15. The method of claim 12, with said primary control vehicle including an operator having a controller with a first contact for providing said normal control operation of the train and a second contact for providing said handback control operation of the train.

16. The method of claim 12, with the primary vehicle including a controller for energizing the first signal circuit in the primary control vehicle and energizing the second signal circuit in each of the primary and secondary control vehicles for controlling the train in response to said control signal.

* * * * *